US010347169B2

(12) United States Patent
Perdices-Gonzalez et al.

(10) Patent No.: US 10,347,169 B2
(45) Date of Patent: Jul. 9, 2019

(54) DISPLAY WITH HIGH TRANSPARENCY

(71) Applicant: Samsung Electronics Company, Ltd., Suwon, Gyeonggi-Do (KR)

(72) Inventors: Sergio Perdices-Gonzalez, Santa Clara, CA (US); Sajid Sadi, San Jose, CA (US); Pranav Mistry, Cupertino, CA (US)

(73) Assignee: Samsung Electronics Company, Ltd., Suwon (KR)

( * ) Notice: Subject to any disclaimer, the term of this patent is extended or adjusted under 35 U.S.C. 154(b) by 276 days.

(21) Appl. No.: 14/614,280

(22) Filed: Feb. 4, 2015

(65) Prior Publication Data

US 2015/0228089 A1 Aug. 13, 2015

Related U.S. Application Data

(60) Provisional application No. 62/039,880, filed on Aug. 20, 2014, provisional application No. 61/955,033,
(Continued)

(51) Int. Cl.
*G09G 3/20* (2006.01)
*G09G 3/32* (2016.01)
(Continued)

(52) U.S. Cl.
CPC ..... *G09G 3/2092* (2013.01); *G09G 3/32* (2013.01); *G09G 3/3208* (2013.01); *G09G 3/348* (2013.01);
(Continued)

(58) Field of Classification Search
CPC .... G09G 3/2092; G09G 3/348; G09G 3/3208; G09G 3/36; G09G 3/32; G09G 3/344–3/3446
See application file for complete search history.

(56) References Cited

U.S. PATENT DOCUMENTS 6,757,039 B2 6/2004 Ma
7,956,820 B2 6/2011 Huitema
(Continued)

FOREIGN PATENT DOCUMENTS

CN 102498511 A 6/2012
CN 102665819 A 9/2012
(Continued)

OTHER PUBLICATIONS

Merriam-Webster online dictionary, Defintion of Proportional as published in May 17, 2013 and retrieved through the wayback machine.*
(Continued)

*Primary Examiner* — Liliana Cerullo
(74) *Attorney, Agent, or Firm* — Baker Botts L.L.P.

(57) ABSTRACT

In one embodiment, a display screen includes one or more pixels that are configured to operate in multiple modes. The multiple modes include a first mode in which the one or more pixels modulate, absorb, or reflect visible light and a second mode in which the one or more pixels are substantially transparent to visible light. When the one or more pixels are in the second mode a component behind the display screen is viewable through the one or more pixels.

27 Claims, 18 Drawing Sheets

Related U.S. Application Data filed on Mar. 18, 2014, provisional application No. 61/937,062, filed on Feb. 7, 2014.

(51) Int. Cl.
*G09G 3/3208* (2016.01)
*G09G 3/36* (2006.01)
*G09G 3/34* (2006.01)

(52) U.S. Cl.
CPC ..... *G09G 3/36* (2013.01); *G09G 3/3446* (2013.01); *G09G 2300/023* (2013.01); *G09G 2300/0456* (2013.01); *G09G 2330/021* (2013.01)

(56) References Cited

U.S. PATENT DOCUMENTS

| | | | | |
|---|---|---|---|---|
| 8,089,686 | B2 | 1/2012 | Addington | |
| 8,675,273 | B2 | 3/2014 | Yang | |
| 8,687,132 | B2 | 4/2014 | Nakayama | |
| 8,890,371 | B2 | 11/2014 | Pance | |
| 9,373,290 | B2 * | 6/2016 | Lee | G09G 3/344 |
| 2003/0231162 | A1 * | 12/2003 | Kishi | G02F 1/167 345/107 |
| 2004/0145696 | A1 * | 7/2004 | Oue | G02F 1/167 349/167 |
| 2004/0207569 | A1 | 10/2004 | Ho | |
| 2004/0239613 | A1 * | 12/2004 | Kishi | G02F 1/167 345/107 |
| 2005/0094040 | A1 | 5/2005 | Wang | |
| 2006/0061530 | A1 * | 3/2006 | Yuasa | G02F 1/1347 345/88 |
| 2006/0119568 | A1 | 6/2006 | Ikeda | |
| 2008/0192013 | A1 | 8/2008 | Barrus | |
| 2008/0211734 | A1 | 9/2008 | Huitema | |
| 2009/0243995 | A1 | 10/2009 | Kimura | |
| 2011/0000307 | A1 | 1/2011 | Jevons | |
| 2011/0043435 | A1 * | 2/2011 | Hebenstreit | G02B 26/005 345/5 |
| 2011/0050545 | A1 | 3/2011 | Namm | |
| 2011/0163977 | A1 | 7/2011 | Barnhoefer | |
| 2011/0164047 | A1 | 7/2011 | Pance | |
| 2011/0175902 | A1 | 7/2011 | Mahowald | |
| 2011/0225366 | A1 | 9/2011 | Izadi | |
| 2011/0249202 | A1 | 10/2011 | Park | |
| 2011/0267279 | A1 | 11/2011 | Alvarez Rivera | |
| 2011/0191921 | P1 | 12/2011 | Hsiao | |
| 2012/0105384 | A1 | 5/2012 | Clayton | |
| 2012/0105482 | A1 | 5/2012 | Xu | |
| 2012/0140147 | A1 | 6/2012 | Satoh | |
| 2012/0188295 | A1 * | 7/2012 | Joo | G02F 1/167 345/690 |
| 2013/0128335 | A1 | 5/2013 | Parry-Jones | |
| 2013/0155092 | A1 * | 6/2013 | Chuang | G09G 3/344 345/589 |
| 2013/0242372 | A1 | 9/2013 | Park | |
| 2013/0257708 | A1 | 10/2013 | Wang | |
| 2013/0264728 | A1 | 10/2013 | Myoung | |
| 2013/0271445 | A1 | 10/2013 | Park | |
| 2013/0285881 | A1 | 10/2013 | Loo | |
| 2013/0314634 | A1 | 11/2013 | Koo | |
| 2014/0009454 | A1 | 1/2014 | Lee | |
| 2014/0014915 | A1 | 1/2014 | Koo | |
| 2015/0002769 | A1 | 1/2015 | Kalyanasundaram | |
| 2015/0070748 | A1 | 3/2015 | Ishino | |
| 2015/0228217 | A1 | 8/2015 | Perdices-Gonzalez | |

FOREIGN PATENT DOCUMENTS

| | | | |
|---|---|---|---|
| CN | 102763055 | A | 10/2012 |
| CN | 103293754 | A | 9/2013 |
| CN | 103376595 | A | 10/2013 |
| EP | 1922607 | | 5/2008 |
| EP | 2541317 | A2 | 1/2013 |
| EP | 2669735 | A1 | 12/2013 |
| JP | 2006-128241 | | 5/2006 |
| JP | 2008-102660 | | 5/2008 |
| JP | 2013-156635 | | 8/2013 |
| KR | 2009-0110174 | | 10/2009 |
| KR | 2011-0113273 | | 10/2011 |
| KR | 2012-0010683 | | 2/2012 |
| KR | 2012-0049018 | | 5/2012 |
| KR | 2012-0120799 | | 11/2012 |
| WO | WO 2006/000945 | A1 | 1/2006 |
| WO | WO 2008/020930 | A2 | 2/2008 |

OTHER PUBLICATIONS

Non-Final Office Action for U.S. Appl. No. 14/614,261, dated Aug. 26, 2016.
Final Office Action for U.S. Appl. No. 14/614,261 dated Feb. 24, 2017.
Extended Search Report for EP Patent Application No. 15746106.2 dated May 29, 2017.
Response to Non-Final Office Action for U.S. Appl. No. 14/614,261 dated Jan. 26, 2017.
Response to Final Office Action for U.S. Appl. No. 14/614,261 dated May 24, 2017.
Response to Non-Final Office Action for U.S. Appl. No. 14/614,261 dated Oct. 23, 2017.
Extended Search Report for EP Patent Application No. 15746493.4-1914 dated Sep. 19, 2017.
Final Office Action for U.S. Appl. No. 14/614,261 dated Nov. 16, 2017.
Communication Pursuant to Article 94(3) for EP Application No. 15 746 106.2-1210 dated Apr. 16, 2018.
CN Office Action for Application No. 201580016728.6 (No English translation) dated Jul. 23, 2018.
Communication Pursuant to Article 94(3) for EP Application No. 15 746 493.4-1210 dated Nov. 5, 2018.
CN Office Action for Application No. 201580012583.2 (with English translation) dated Nov. 6, 2018.

* cited by examiner

DISPLAY WITH HIGH TRANSPARENCY

PRIORITY

This application claims the benefit, under 35 U.S.C. § 119(e), of: U.S. Provisional Patent Application No. 61/937,062 filed 7 Feb. 2014, which is incorporated herein by reference; U.S. Provisional Patent Application No. 61/955,033 filed 18 Mar. 2014, which is incorporated herein by reference; and U.S. Provisional Patent Application No. 62/039,880 filed 20 Aug. 2014, which is incorporated herein by reference.

TECHNICAL FIELD

This disclosure generally relates to electronic displays.

BACKGROUND

There are a number of different types of electronic visual displays, such as for example, liquid-crystal displays (LCDs), light-emitting diode (LED) displays, organic light-emitting diode (OLED) displays, polymer-dispersed liquid-crystal displays, electrochromic displays, electrophoretic displays, and electrowetting displays. Some displays are configured to reproduce color images or video at particular frame rates, while other displays may show static or semi-static content in color or black and white. A display may be provided as part of a desktop computer, laptop computer, tablet computer, personal digital assistant (PDA), smartphone, wearable device (e.g., smartwatch), satellite navigation device, portable media player, portable game console, digital signage, billboard, kiosk computer, point-of-sale device, or other suitable device. A control panel or status screen in an automobile or on a household or other appliance may include a display. Displays may include a touch sensor that may detect the presence or location of a touch or an object (e.g., a user's finger or a stylus) within a touch-sensitive area of the touch sensor. A touch sensor may enable a user to interact directly with what is displayed on a display.

DESCRIPTION OF EXAMPLE EMBODIMENTS

Figure 1:
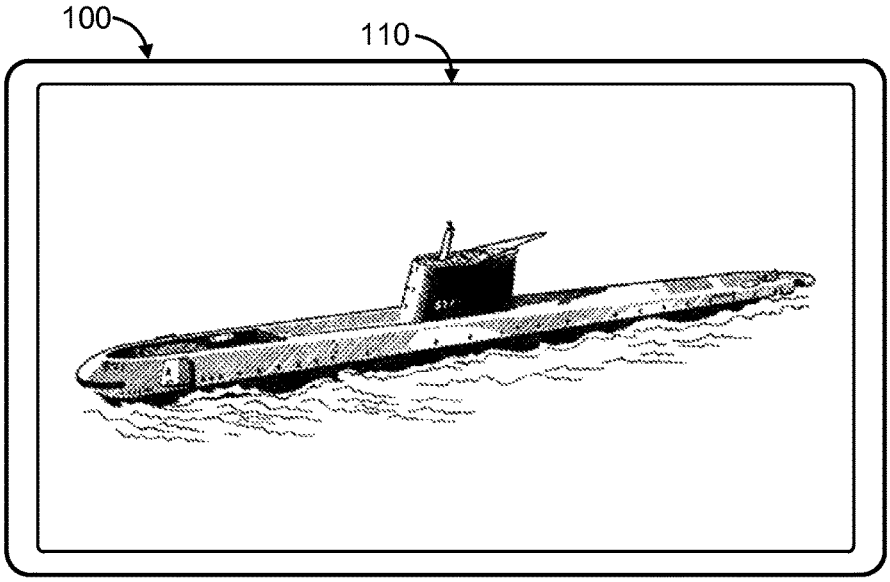
FIG. 1 illustrates an example display device with a display showing an image of a submarine.

FIG. 1 illustrates example display device 100 with display 110 showing an image of a submarine. As an example and not by way of limitation, display 110 in FIG. 1 may be showing a movie in color with high-definition video at a frame rate of 30 frames per second (FPS). In particular embodiments, display device 100 may be configured to operate as an e-book reader, global positioning system (GPS) device, camera, personal digital assistant (PDA), computer monitor, television, video screen, conference-room display, large-format display (e.g., information sign or billboard), handheld electronic device, mobile device (e.g., cellular telephone or smartphone), tablet device, wearable device (e.g., smartwatch), other suitable electronic device, or any suitable combination thereof. In particular embodiments, display device 100 may include electronic visual display 110, which may be referred to as a display screen or as display 110. In particular embodiments, display device 100 may include a power source (e.g., a battery), a wireless device for sending or receiving information using a wireless communication protocol (e.g., BLUETOOTH, WI-FI, or cellular), a processor, a computer system, a touch sensor, a display controller for controlling display 110, or any other suitable device or component. As an example and not by way of limitation, display device 100 may include display 110 and a touch sensor that allows a user to interact with what is displayed on display 110 using a stylus or the user's finger. In particular embodiments, display device 100 may include a device body, such as for example an enclosure, chassis, or case that holds or contains one or more components or parts of display device 100. As an example and not by way of limitation, display 110 may include a front and rear display (as described below), and the front and rear displays (as well as other devices) may each be coupled (e.g., mechanically affixed, connected, or attached, such as for example with epoxy or with one or more mechanical fasteners) to a device body of display device 100.

In particular embodiments, display 110 may include any suitable type of display, such as for example, a liquid-crystal display (LCD), light-emitting diode (LED) display, organic light-emitting diode (OLED) display, polymer-dispersed liquid-crystal (PDLC) display, electrochromic display, electrophoretic display, electro-dispersive display, or electrowetting display. In particular embodiments, display 110 may include any suitable combination of two or more suitable types of displays. As an example and not by way of limitation, display 110 may include an LCD or OLED display combined with an electrophoretic or electrowetting display. In particular embodiments, display 110 may include an emissive display, where an emissive display includes emissive pixels that are configured to emit or modulate visible light. This disclosure contemplates any suitable type of emissive displays, such as for example, LCDs, LED displays, or OLED displays. In particular embodiments, display 110 may include a non-emissive display, where a non-emissive display includes non-emissive pixels that may be configured to absorb, transmit, or reflect ambient visible light. This disclosure contemplates any suitable type of non-emissive displays, such as for example, PDLC displays, electrochromic displays, electrophoretic displays, electro-dispersive displays, or electrowetting displays. In particular embodiments, a non-emissive display may include non-emissive pixels that may be configured to be substantially transparent (e.g., the pixels may transmit greater than 70%, 80%, 90%, 95%, or any suitable percentage of light incident on the display). A display with pixels that may be configured to be substantially transparent may be referred to as a display with high transparency or a high-transparency display. In particular embodiments, ambient light may refer to light originating from one or more sources located outside of display device 100, such as for example room light or sunlight. In particular embodiments, visible light (or, light) may refer to light that is visible to a human eye, such as for example light with a wavelength in the range of approximately 400 to 750 nanometers. Although this disclosure describes and illustrates particular displays having particular display types, this disclosure contemplates any suitable displays having any suitable display types.

In particular embodiments, display 110 may be configured to display any suitable information or media content, such as for example, digital images, video (e.g., a movie or a live video chat), websites, text (e.g., an e-book or a text message), or applications (e.g., a video game), or any suitable combination of media content. In particular embodiments, display 110 may display information in color, black and white, or a combination of color and black and white. In particular embodiments, display 110 may display information that changes frequently (e.g., a video with a frame rate of 30 or 60 FPS) or may display semi-static information that changes relatively infrequently (e.g., text or a digital image that may be updated approximately once per hour, once per minute, once per second, or any suitable update interval). As an example and not by way of limitation, one or more portions of display 110 may be configured to display a video in color, and one or more other portions of display 110 may be configured to display semi-static information in black and white (e.g., a clock that is updated once per second or once per minute). Although this disclosure describes and illustrates particular displays configured to display particular information in a particular manner, this disclosure contemplates any suitable displays configured to display any suitable information in any suitable manner.

Figure 2:
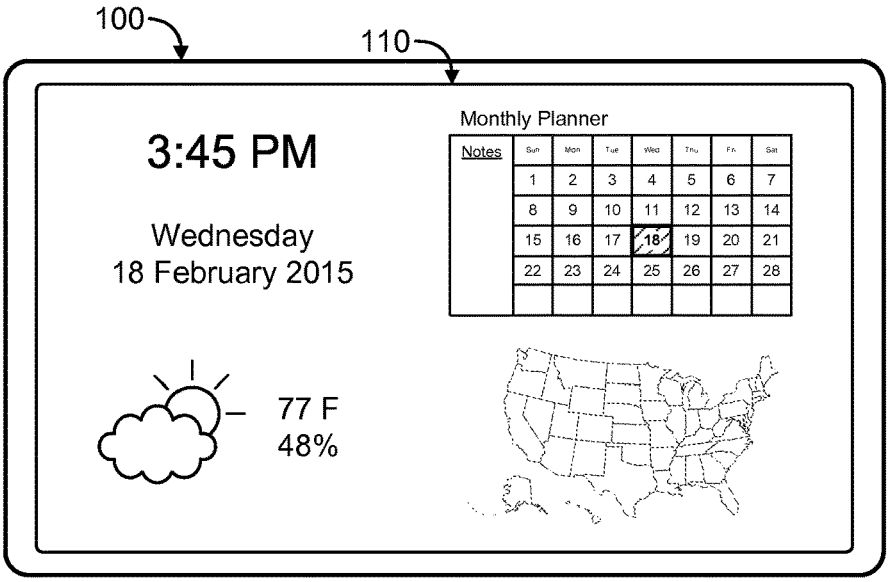
FIG. 2 illustrates the example display device of FIG. 1 with the display presenting information in a semi-static mode.

FIG. 2 illustrates the example display device 100 of FIG. 1 with display 110 presenting information in a semi-static mode. In particular embodiments, display 110 may be configured to have two modes of operation, a dynamic (or, emissive) mode and a semi-static (or, non-emissive) mode. In the example of FIG. 1, display 110 may be operating in a dynamic mode (e.g., showing a video), and in the example of FIG. 2, display 110 may be operating in a semi-static mode displaying the time, date, weather, a monthly planner, and a map. In FIG. 2, the information displayed in semi-static mode may be updated at relatively long intervals (e.g., every 1, 10, or 60 seconds).

When operating in a dynamic mode (as illustrated in FIG. 1), display 110 may have one or more of the following attributes: display 110 may display content (e.g., text, images, or video) in bright or vivid color, with high resolution, or at a high frame rate (e.g., a frame rate greater than or equal to 20 FPS); or display 110 may operate in an emissive mode where display device 100 or display 110 includes a light source or illumination source. Operating in an emissive mode may allow display 110 to display information without need for an external source of light (e.g., display 110 may be viewable in a darkened room). For an LCD, the light source may be a frontlight or backlight that illuminates the LCD which then modulates the light source to generate (or emit) an image. For an OLED display, the pixels of the OLED display may each produce light (e.g., from red, green, and blue subpixels) that results in an emitted image. In particular embodiments, when operating in a dynamic mode, display 110 may display content in color, black and white, or both color and black and white.

When operating in a semi-static mode (as illustrated in FIG. 2), display 110 may have one or more of the following attributes: display 110 may display text or images in color or black and white; display 110 may operate in a non-emissive mode; display 110 may appear reflective; display 110 may have a relatively low update rate (e.g., a frame rate or update rate less than 0.1, 1, or 10 FPS); or display 110 may consume little or no power. As an example and not by way of limitation, display 110 operating in a dynamic mode may consume approximately 1-50 watts of power (depending, at least in part, on the type and size of display 110), while, when operating in a semi-static mode, display 110 may consume less than 0.1, 1, 10, or 100 milliwatts of power. As another example and not by way of limitation, display 110 operating in a semi-static mode may only consume power when updating the content being displayed and may consume no power or negligible power (e.g., less than 10 μW) while displaying static, unchanging content. Display 110 operating in a non-emissive mode may refer to the use of external ambient light (e.g., room light or sunlight) to provide illumination for display 110 without using an internal light source that is included in display device 100 or display 110. As an example and not by way of limitation, display 110 may include an electro-dispersive or electrowetting display that uses ambient light as an illumination source. In particular embodiments, display 110 operating in a non-emissive mode may refer to information being displayed with non-emissive pixels. In particular embodiments, a non-emissive pixel may refer to a pixel that absorbs, transmits, or reflects light. In particular embodiments, a non-emissive pixel may refer to a pixel that does not emit visible light or a pixel that does not modulate an amount (e.g., an intensity) of light or an amount of a particular color of visible light.

In particular embodiments, display device 100 may be configured as a conference-room display or information sign, and when operating in a semi-static mode, display 110 may display a clock, weather information, a meeting calendar, artwork, a poster, meeting notes, or a company logo, or any other suitable information or suitable combination of information. In particular embodiments, display device 100 may be configured as a personal display device (e.g., a television, tablet, or smartphone), and when operating in a semi-static mode, display 110 may display personalized content, such as for example, favorite TV show reminders, family photo album, customized widget tiles, headline news, stock prices, social-network feeds, daily coupons, favorite sports scores, a clock, weather information, or traffic conditions, or any other suitable information or suitable combination of information. As an example and not by way of limitation, while a person is getting ready for work in the morning, their television or smartphone may display (in a semi-static mode) the time, the weather, or traffic conditions related to the person's commute. In particular embodiments, display device 100 may include a touch sensor, and display 110 may display (in a semi-static mode) a bookshelf or a white board that a user can interact with through the touch sensor. In particular embodiments, a user may be able to select a particular operating mode for display 110, or display 110 may automatically switch between dynamic and semi-static modes. As an example and not by way of limitation, when display device 100 goes into a sleep state, display 110 may automatically switch to operating in a low-power, semi-static mode. In particular embodiments, when operating in a semi-static mode, display 110 may be reflective and may act as a mirror. As an example and not by way of limitation, one or more surfaces or layers in display 110 may include a reflector or a surface with a reflective coating, and when display 110 is in a semi-static mode, display 110 may act as a mirror.

In particular embodiments, display 110 may include a combination of two or more types of displays oriented substantially parallel to one another with one display located behind the other display. As examples and not by way of limitation, display 110 may include an LCD located behind a PDLC display, an OLED display located behind an electrochromic display, or an LCD located behind an electrowetting display. In particular embodiments, display 110 may include two different types of displays, and display 110 may be referred to as a dual-mode display or a dual display. In particular embodiments, dual-mode display 110 may include a dynamic (or, emissive) display and a semi-static (or, non-emissive) display. As an example and not by way of limitation, display 110 may include a dynamic color display configured to show videos in an emissive mode and at a high frame rate (e.g., 24, 25, 30, 60, 120, or 240 FPS, or any other suitable frame rate), as illustrated in FIG. 1. Display 110 may also include a semi-static display configured to show information in black and white or color in a low-power, non-emissive mode with relatively low frame rate or update rate (e.g., 0.1, 1, or 10 FPS), as illustrated in FIG. 2. For such an example dual-mode display 110, the dynamic display may be located in front of or behind the semi-static display. As an example and not by way of limitation, the dynamic display may be located behind the semi-static display, and when the dynamic display is active, the semi-static display may be configured to be substantially transparent so that the dynamic display is viewable. Additionally, when display 110 is operating in a semi-static mode, the semi-static display may display information (e.g., text or images), and the dynamic display may be inactive or powered off. In particular embodiments, a dynamic display may appear white, reflective, dark or black (e.g., optically absorbing), or substantially transparent when the dynamic display is inactive or powered off. In particular embodiments, a display that is inactive or powered off may refer to a display that is receiving little or no electrical power (e.g., from a display controller), and in an inactive or powered-off state, a display may consume little (e.g., less than 10 μW) or no electrical power. In particular embodiments, a dynamic display may be referred to as an emissive display, and a semi-static display may be referred to as a non-emissive display. Although this disclosure describes and illustrates particular combinations of particular display types, this disclosure contemplates any suitable combinations of any suitable display types.

In particular embodiments, dual-mode display 110 may include a single type of display that has two or more operating modes (e.g., a dynamic display mode and a low-power, semi-static display mode). As an example and not by way of limitation, display 110 may include an LCD that, in a dynamic mode of operation, operates as an emissive display that modulates light from a backlight or frontlight. In a semi-static mode of operation, display 110 may operate as a low-power, non-emissive display that uses ambient light (e.g., room light or sunlight) to provide illumination for the LCD (with the backlight or frontlight turned off).

Figure 3:
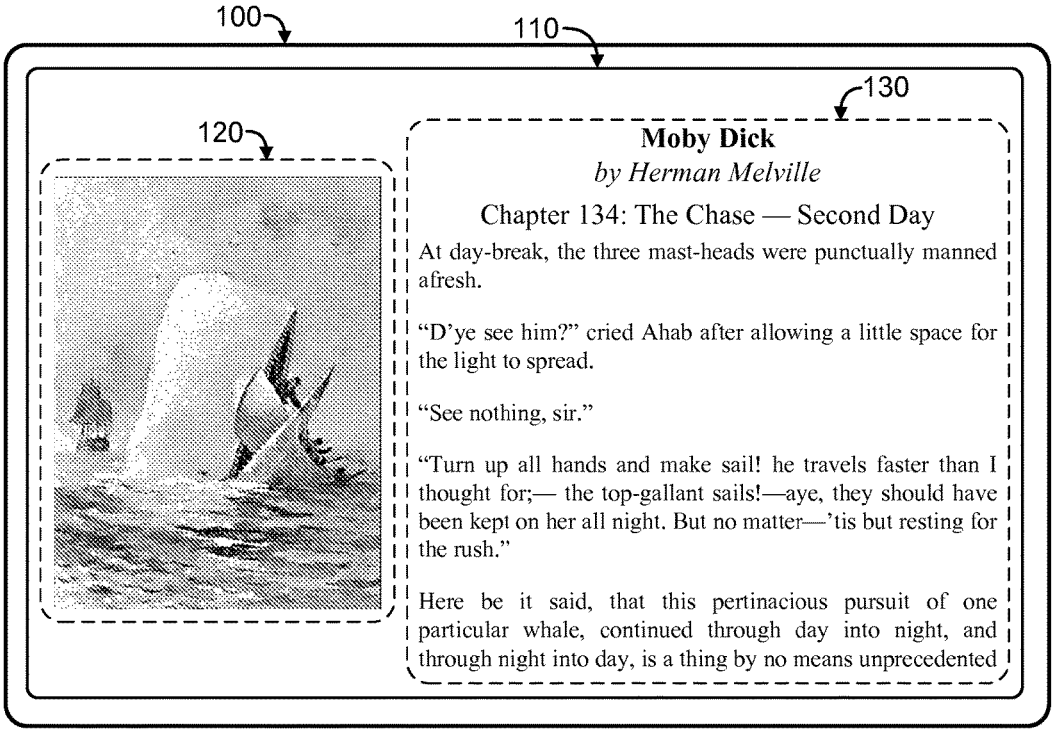
FIGS. 3 and 4 each illustrate an example display device with a display having different regions configured to operate in different display modes.
Figure 4:
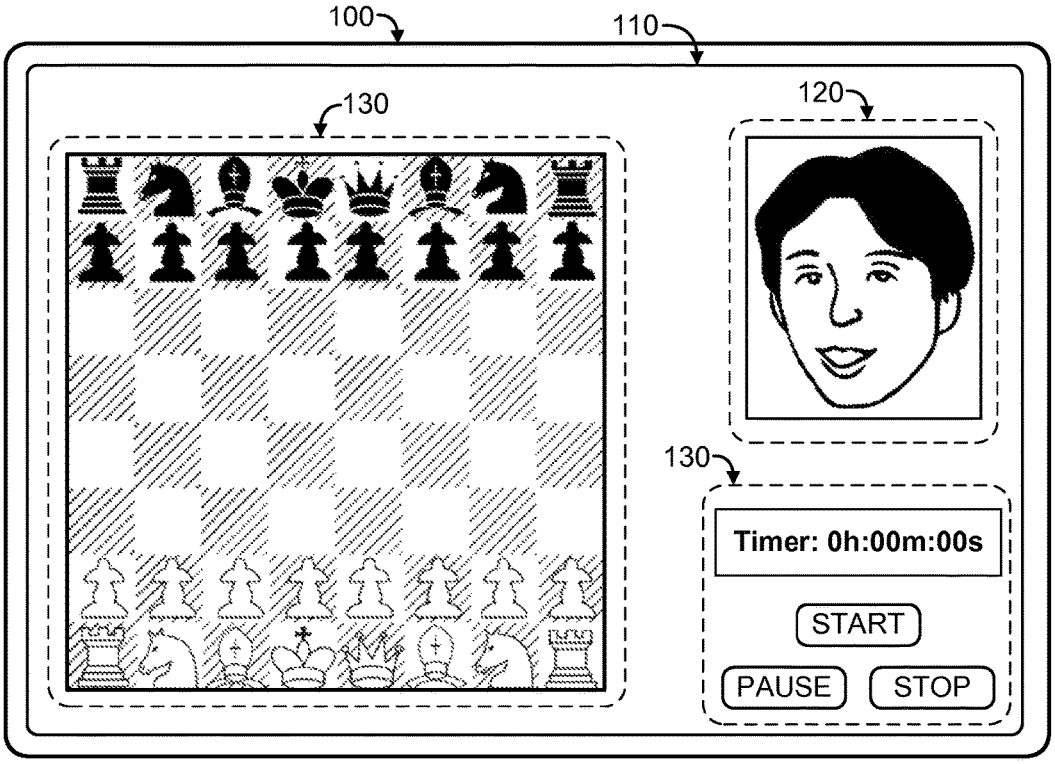

FIGS. 3 and 4 each illustrate example display device 100 with display 110 having different regions configured to operate in different display modes. In particular embodiments and as illustrated in FIGS. 3 and 4, dual-mode display 110 may operate in a hybrid-display mode, where display 110 includes multiple portions, areas, or regions, and each portion of display 110 is configured to operate in a dynamic or semi-static mode. In particular embodiments, one or more dynamic portions 120 of display 110 may be configured to operate in a dynamic mode (e.g., displaying an image or video using light generated by display device 100 or display 110), and one or more semi-static portions 130 of display 110 may be configured to operate in a semi-static mode (e.g., displaying text or an image in a non-emissive mode with a low update rate). As an example and not by way of limitation, a dynamic portion 120 of display 110 may display an image or video in high resolution or with vivid or bright color, and a semi-static portion 130 of display 110 may display information in black and white with a relatively low update rate (e.g., text, a game board, or a clock that may be updated approximately once per second or once per minute). The semi-static portions 130 may be illuminated using an external light source, such as for example, ambient room light. In particular embodiments, dual-mode display 110 may include a dynamic display for displaying dynamic portions 120 and a semi-static display for displaying semi-static portions 130. As an example and not by way of limitation, the dynamic display may be located behind the semi-static display, and the portions of the semi-static display located directly in front of dynamic portions 120 may be configured to be substantially transparent so that dynamic portions 120 are viewable through those portions of the semi-static display. Additionally, areas of the dynamic display located outside dynamic portions 120 may be inactive or turned off. As another example and not by way of limitation, the semi-static display may be located behind the dynamic display, and the portions of the dynamic display located directly in front of semi-static portions 130 may be configured to be substantially transparent so that semi-static portions 130 are viewable through those portions of the dynamic display.

In the example of FIG. 3, display device 100 is operating as an e-book reader showing an image and a portion of text from the book *Moby Dick*. Display 110 has a dynamic portion 120 showing the image, which may be displayed in an emissive mode with vivid or bright color, and display 110 has a semi-static portion 130 showing the text, which may be displayed in black and white and in a non-emissive mode (e.g., illuminated with ambient light). In particular embodiments, the areas of the dynamic display outside of dynamic portion 120 may be inactive or turned off (e.g., pixels or backlight located outside of dynamic portion 120 may be turned off). In the example of FIG. 4, display device 100 is operating as a chess game where two players can play remotely. Display 110 has a dynamic portion 120 that shows a live video of the other player, which allows the two players to interact during a chess match. Display 110 also has two semi-static portions 130 showing the chess board, a timer, and game controls. In particular embodiments, display 110 may be reconfigurable so that dynamic portions 120 and semi-static portions 130 may be moved or resized depending on the application that is being run on display device 100. As an example and not by way of limitation, display device 100 illustrated in FIGS. 3 and 4 may be the same device configured to operate as an e-reader (in FIG. 3) and as a remote game player (in FIG. 4). In particular embodiments, display 110 may have any suitable number of dynamic portions 120 and any suitable number of semi-static portions 130, and each dynamic portion 120 and semi-static portion 130 may have any suitable size and any suitable shape. As an example and not by way of limitation, a dynamic portion 120 or a semi-static portion 130 may cover approximately one-sixteenth, one-eighth, one-fourth, one-half, or all of display 110 and may have a square, rectangular, or circular shape. As another example and not by way of limitation, a dynamic portion 120 or a semi-static portion 130 may include 1, 2, 10, 100, or any suitable number of pixels. Although this disclosure describes and illustrates particular displays having particular numbers of regions operating in particular display modes and having particular sizes and shapes, this disclosure contemplates any suitable displays having any suitable numbers of regions operating in any suitable display modes and having any suitable sizes and shapes.

Figure 5:
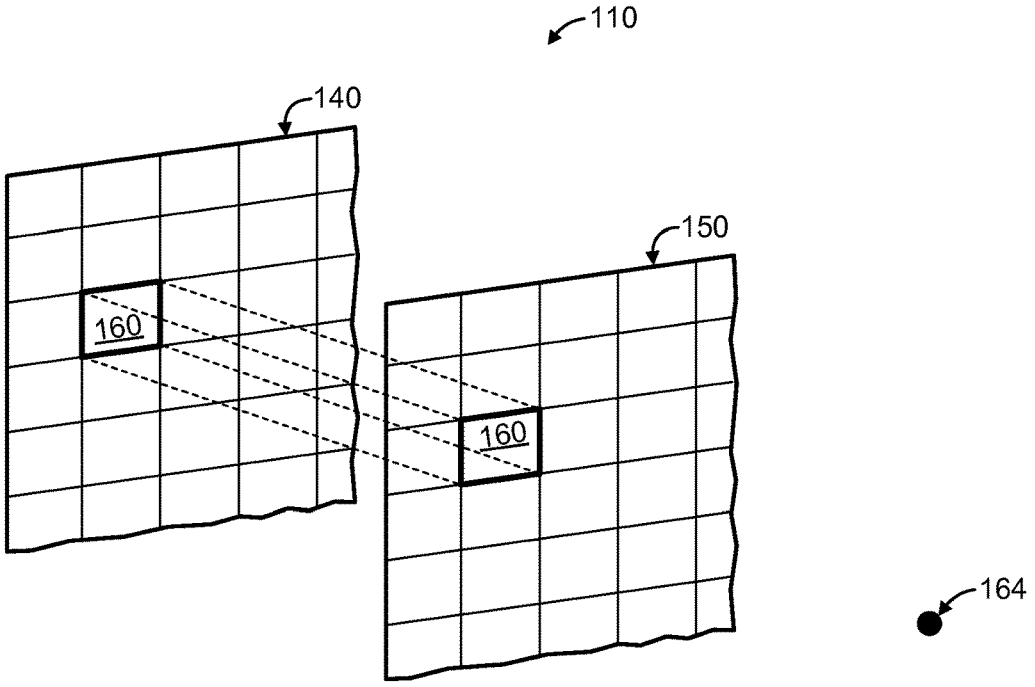
FIGS. 5 and 6 each illustrate an exploded view of a portion of an example display.
Figure 6:
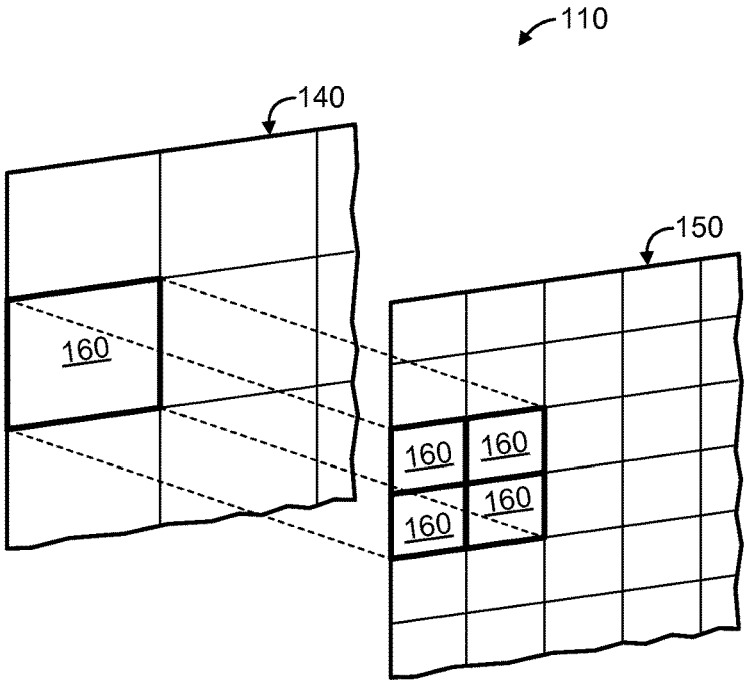

FIGS. 5 and 6 each illustrate an exploded view of a portion of example display 110. In particular embodiments, display 110 may include front display 150 and rear display 140, where rear display 140 is located behind front display 150. As an example and not by way of limitation, front display 150 may be an electrowetting display, and rear display 140 may be an OLED display located directly behind front display 150. In particular embodiments, front display 150 or rear display 140 may each be referred to as layers, and each layer of display 110 may include one or more displays. As an example and not by way of limitation, a first layer of display 110 may include or may be referred to as front display 150, and a second layer of display 110 may include or may be referred to as rear display 140. In particular embodiments, display 110 may include other surfaces, layers, or devices not shown in FIG. 5 or 6, where the other surfaces, layers, or devices may be disposed between displays 140 and 150, behind rear display 140, or in front of front display 150. As an example and not by way of limitation, display 110 may include a protective cover, a glare-reduction layer (e.g., a polarizer or a layer with an antireflection coating), or a touch-sensor layer located in front of front display 150. As another example and not by way of limitation, display 110 may include a backlight located behind rear display 140 or a frontlight located between displays 140 and 150.

In particular embodiments, display 110 of display device 100 may have an associated viewing cone, e.g., an angular region or a solid angle within which display 110 can be reasonably viewed. In particular embodiments, relative positions of surfaces, layers, or devices of display 110 may be referenced with respect to a person viewing display 110 from within an associated viewing cone. In the example of FIG. 5, a person viewing display 110 from point 164 may be referred to as viewing display 110 from within its viewing cone and may be referred to as viewing display 110 from the front of display 110. With respect to point 164 in FIG. 5, front display 150 is disposed or located in front of rear display 140, and similarly, rear display 140 is disposed or located behind front display 150.

In particular embodiments, display 110 may form a sandwich-type structure that includes displays 140 and 150 (as well as any additional surfaces, layers, or devices that are part of display 110) combined together in a layered manner. As an example and not by way of limitation, displays 140 and 150 may overlay one another with a small air gap between facing surfaces (e.g., a front surface of display 140 and a back surface of display 150) or with facing surfaces in contact with, adhered to, or bonded to one another. In particular embodiments, displays 140 and 150 may be bonded together with a substantially transparent adhesive, such as for example, an optically clear adhesive. Although this disclosure describes and illustrates particular displays having particular layers and particular structures, this disclosure contemplates any suitable displays having any suitable layers and any suitable structures. Moreover, while this disclosure describes specific examples of a rear display behind a front display, this disclosure contemplates any suitable number of displays located behind any suitable number of other displays. For example, this disclosure contemplates any suitable number of displays located between displays 140 and 150 of FIG. 5, and that those displays may have any suitable characteristics of the displays described herein. Thus, for example, a device may include three displays: a front display, a middle display behind the front display, and a rear display behind the middle display. Portions of the middle display may be viewable through the front display when corresponding portions of the front display are transparent, and portions of the rear display may be viewable through the middle and front displays when corresponding portions of the middle and front displays are transparent.

In particular embodiments, front display 150 and rear display 140 may each include multiple pixels 160 arranged in a regular or repeating pattern across a surface of display 140 or 150. This disclosure contemplates any suitable type of pixel 160, such as for example, emissive pixels (e.g., an LCD or an OLED pixel) or non-emissive pixels (e.g., an electrophoretic or electrowetting pixel). Moreover, pixels 160 may have any suitable size (e.g., a width or height of 25 μm, 50 μm, 100 μm, 200 μm, or 500 μm) and any suitable shape (e.g., square, rectangular, or circular). In particular embodiments, each pixel 160 may be an individually addressable or controllable element of display 140 or 150 such that a state of a pixel 160 may be set (e.g., by a display controller) independent of the states of other pixels 160. In particular embodiments, the addressability of each pixel 160 may be provided by one or more control lines coupled from each pixel 160 to a display controller. In particular embodiments, each pixel 160 may have its own dedicated control line, or each pixel 160 may share one or more control lines with other pixels 160. As an example and not by way of limitation, each pixel 160 may have one or more electrodes or electrical contacts connected by a control line to a display controller, and one or more corresponding voltages or currents provided by the display controller to pixel 160 may set the state of pixel 160. In particular embodiments, pixel 160 may be a black-and-white pixel that may be set to various states, such as for example, black, white, partially transparent, transparent, reflective, or opaque. As an example and not by way of limitation, a black-and-white pixel may be addressed using one control signal (e.g., the pixel is off, or black, when 0 V is applied to a pixel control line, and the pixel appears white or transparent when 5 V is applied). In particular embodiments, pixel 160 may be a color pixel that may include three or more subpixels (e.g., a red, green, and blue subpixel), and pixel 160 may be set to various color states (e.g., red, yellow, orange, etc.) as well as black, white, partially transparent, transparent, reflective, or opaque. As an example and not by way of limitation, a color pixel may have associated control lines that provide control signals to each of the corresponding subpixels of the color pixel.

In particular embodiments, a display controller may be configured to individually or separately address each pixel 160 of front display 150 and rear display 140. As an example and not by way of limitation, a display controller may configure a particular pixel 160 of front display 150 to be in an active or emissive state, and the display controller may configure one or more corresponding pixels 160 of rear display 140 to be in an off or inactive state. In particular embodiments, pixels 160 may be arranged along rows and columns, and an active-matrix scheme may be used to provide drive signals to each pixel 160 (or the subpixels of each pixel 160). In an active-matrix approach, each pixel 160 (or each subpixel) has an associated capacitor and transistor deposited on a display's substrate, where the capacitor holds charge (e.g., for one screen refresh cycle) and the transistor supplies current to the pixel 160. To activate a particular pixel 160, an appropriate row control line is turned on while a drive signal is transmitted along a corresponding column control line. In other particular embodiments, a passive-matrix scheme may be used to address pixels 160, where a passive matrix includes a grid of columns and rows of conductive metal configured to selectively activate each pixel. To turn on a particular pixel 160, a particular column is activated (e.g., charge is sent down that column), and a particular row is coupled to ground. The particular row and column intersect at the designated pixel 160, and the pixel 160 is then activated. Although this disclosure describes and illustrates particular pixels that are addressed in particular manners, this disclosure contemplates any suitable pixels that are addressed in any suitable manner.

In particular embodiments, front display 150 or rear display 140 may each be a color display or a black and white display, and front display 150 or rear display 140 may each be an emissive or a non-emissive display. As an example and not by way of limitation, front display 150 may be a non-emissive black-and-white display, and rear display 140 may be an emissive color display. In particular embodiments, a color display may use additive or subtractive color techniques to generate color images or text, and the color display may generate colors based on any suitable color system, such as for example a red/green/blue or cyan/magenta/yellow/black color system. In particular embodiments, each pixel of an emissive color display may have three or more subpixels, each subpixel configured to emit a particular color (e.g., red, green, or blue). In particular embodiments, each pixel of a non-emissive color display may have three or more subpixels, each subpixel configured to absorb, reflect, or scatter a particular color (e.g., red, green, or blue).

In particular embodiments, a size or dimension of pixels 160 of front display 150 may be an integral multiple of a corresponding size or dimension of pixels 160 of rear display 140, or vice versa. As an example and not by way of limitation, pixels 160 of front display 150 may be the same size as pixels 160 of rear display 140, or pixels 160 of front display 150 may be twice, three times, or any suitable integral multiple of the size of pixels 160 of rear display 140. As another example and not by way of limitation, pixels 160 of rear display 140 may be twice, three times, or any suitable integral multiple of the size of pixels 160 of front display 150. In the example of FIG. 5, pixels 160 of front display 150 are approximately the same size as pixels 160 of rear display 140. In the example of FIG. 6, pixels 160 of rear display 140 are approximately four times the size (e.g., four times the area) of pixels 160 of front display 150. Although this disclosure describes and illustrates particular pixels having particular sizes, this disclosure contemplates any suitable pixels having any suitable sizes.

In particular embodiments, front display 150 and rear display 140 may be substantially aligned with respect to one another. Front display 150 and rear display 140 may be combined together to form display 110 such that one or more pixels 160 of front display 150 are superposed or overlay one or more pixels 160 of rear display 140. In FIGS. 5 and 6, pixels 160 of front display 150 are aligned with respect to pixels 160 of rear display 140 such that portions of borders of rear-display pixels 160 are situated directly under corresponding portions of borders of front-display pixels 160. In FIG. 5, pixels 160 of front display 150 and rear display 140 have approximately the same size and shape, and, as illustrated by the four dashed lines, pixels 160 are superposed so that each pixel 160 of front display 150 is situated directly over a corresponding pixel 160 of rear display 140 and their borders are substantially aligned. In FIG. 6, front display 150 and rear display 140 are aligned so that each pixel 160 of rear display 140 is situated directly under four corresponding pixels 160 of front display 150, and the borders of each rear-display pixel 160 are situated directly under portions of borders of front-display pixels 160. Although this disclosure describes and illustrates particular displays having particular pixels aligned in particular manners, this disclosure contemplates any suitable displays having any suitable pixels aligned in any suitable manner.

In particular embodiments, front display 150 may include one or more portions, each portion being an area or a part of front display 150 that includes one or more front-display pixels 160. As an example and not by way of limitation, a front-display portion may include a single pixel 160 or a group of multiple contiguous pixels 160 (e.g., 2, 4, 10, 100, 1,000 or any suitable number of pixels 160). As another example and not by way of limitation, a front-display portion may include an area of front display 150, such as for example, an area occupying approximately one tenth, one quarter, one half, or substantially all the area of front display 150. In particular embodiments, a front-display portion may be referred to as a multi-mode portion and may include one or more front-display pixels that are each configured to operate in multiple modes. As an example and not by way of limitation, a multi-mode portion of front display 150 may have one or more front-display pixels that operate in a first mode in which the pixels emit, modulate, absorb, or reflect visible light. Additionally, a multi-mode portion may have one or more front-display pixels that operate in a second mode in which the one or more front-display pixels are substantially transparent to visible light. In particular embodiments, rear display 140 may include one or more rear-display portions located behind at least one multi-mode portion, each rear-display portion including pixels configured to emit, modulate, absorb, or reflect visible light. As an example and not by way of limitation, in FIG. 5, pixel 160 of front display 150 may be configured to be substantially transparent, and the corresponding rear-display pixel 160 (located directly behind front-display pixel 160) may be configured to emit visible light. As another example and not by way of limitation, in FIG. 5, pixel 160 of front display 150 may be configured to absorb or reflect incident visible light (e.g., pixel 160 may be configured as a semi-static portion 130), and the corresponding pixel 160 of rear display 140 may be inactive or turned off. In the example of FIG. 6, pixel 160 of rear display 140 may be configured to emit, modulate, absorb, or reflect visible light, and the four superposed pixels 160 of front display 150 may be configured to be substantially transparent. In the example of FIG. 3, display 110 may include an emissive rear display (e.g., an LCD) and a non-emissive front display (e.g., an electrowetting display). In portion 120 of FIG. 3, the pixels of the rear display may be configured to emit the image illustrated in FIG. 3, while the pixels of the corresponding multi-mode front-display portion may be configured to be substantially transparent. In portion 130 of FIG. 3, the pixels of the front display may be configured to display the text as illustrated, while the pixels of the corresponding rear-display portion may be configured to be inactive or turned off.

Figure 7:
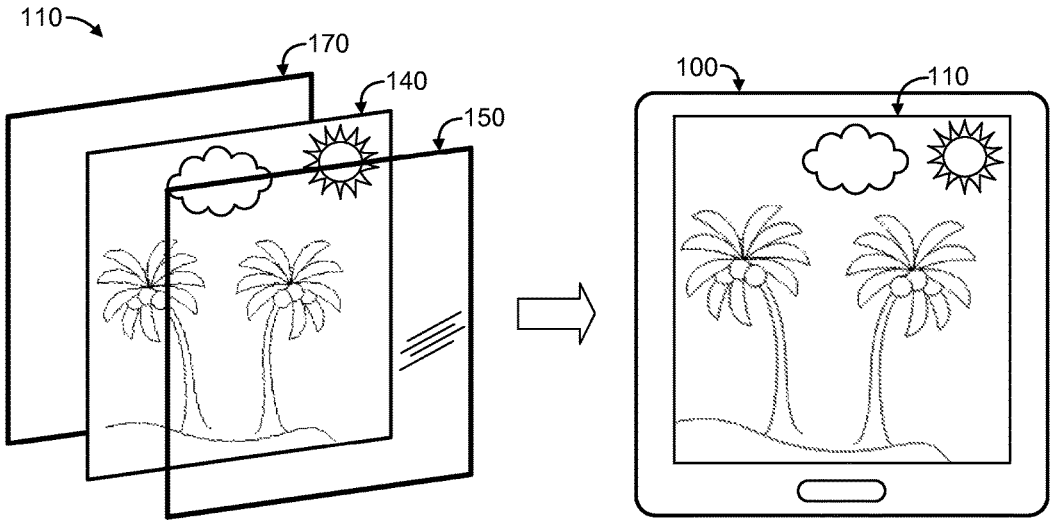
FIGS. 7 and 8 each illustrate an exploded view (on the left) of an example display and (on the right) a front view of an example display device with the example display.
Figure 8:
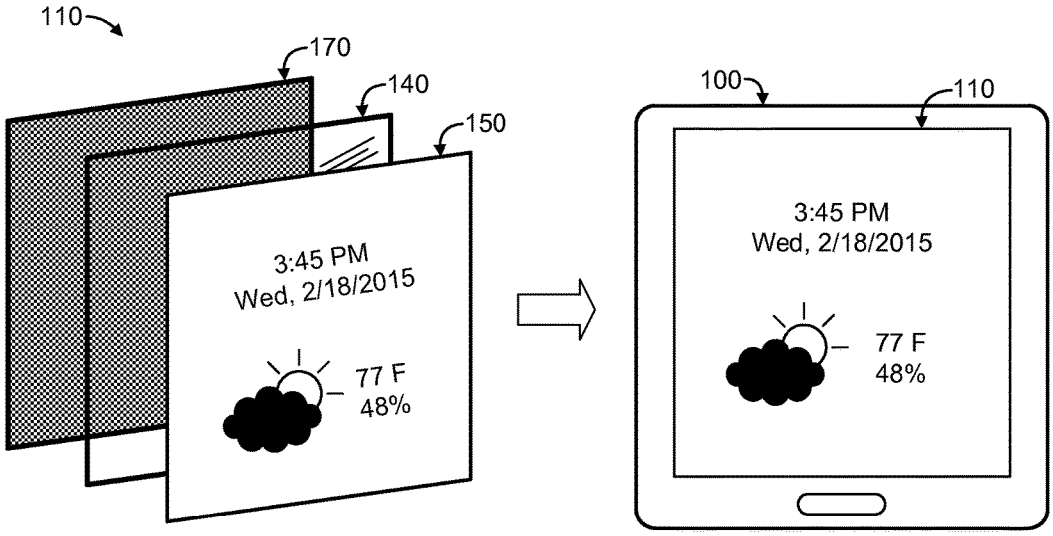

FIGS. 7 and 8 each illustrate an exploded view (on the left) of example display 110 and (on the right) a front view of example display device 100 with example display 110. In FIGS. 7 and 8 (as well as other figures described below), an exploded view illustrates the various layers or devices that make up example display 110, while a front view shows how example display 110 may appear when viewed from the front of display device 100. In particular embodiments, display 110 may include front display 150, rear display 140 (located behind front display 150), and backlight 170 (located behind rear display 140). In the example of FIGS. 7 and 8, front display 150 is a semi-static display, and rear display 140 is an LCD configured to operate as a dynamic display. In FIG. 7, display 110 is operating in a dynamic mode, and in FIG. 8, display 110 is operating in a semi-static mode. In FIG. 7, LCD 140 is showing an image of a tropical scene, and backlight 170 acts as an illumination source, providing light which is selectively modulated by LCD 140.

In particular embodiments, an LCD may include a layer of liquid-crystal molecules positioned between two optical polarizers. As an example and not by way of limitation, an LCD pixel may employ a twisted nematic effect where a twisted nematic cell is positioned between two linear polarizers with their polarization axes arranged at right angles to one another. Based on an applied electric field, the liquid-crystal molecules of an LCD pixel may alter the polarization of light propagating through the pixel causing the light to be blocked, passed, or partially passed by one of the polarizers. In particular embodiments, LCD pixels may be arranged in a matrix (e.g., rows and columns), and individual pixels may be addressed using passive-matrix or active-matrix schemes. In particular embodiments, each LCD pixel may include three or more subpixels, each subpixel configured to produce a particular color component (e.g., red, green, or blue) by selectively modulating color components of a white-light illumination source. As an example and not by way of limitation, white light from a backlight may illuminate an LCD, and each subpixel of an LCD pixel may include a color filter that transmits a particular color (e.g., red, green, or blue) and removes or filters other color components (e.g., a red filter may transmit red light and remove green and blue color components). The subpixels of an LCD pixel may each selectively modulate their associated color components, and the LCD pixel may emit a particular color. The modulation of light by an LCD pixel may refer to an LCD pixel that filters or removes particular amounts of particular color components from an incident illumination source. As an example and not by way of limitation, an LCD pixel may appear white when each of its subpixels (e.g., red, green, and blue subpixels) is configured to transmit substantially all incident light of its respective color component, and an LCD pixel may appear black when it filters or blocks substantially all color components of incident light. As another example and not by way of limitation, an LCD pixel may appear a particular color when it removes or filters out other color components from an illumination source and lets the particular color component propagate through the pixel with little or no attenuation. An LCD pixel may appear blue when its blue subpixel is configured to transmit substantially all blue light, while its red and green subpixels are configured to block substantially all light. Although this disclosure describes and illustrates particular liquid-crystal displays configured to operate in particular manners, this disclosure contemplates any suitable liquid-crystal displays configured to operate in any suitable manner.

In particular embodiments, incident light may refer to light from one or more sources that interacts with or impinges on a surface, such as for example a surface of a display or a pixel. As an example and not by way of limitation, incident light that impinges on a pixel may be partially transmitted through the pixel or partially reflected or scattered from the pixel. In particular embodiments, incident light may strike a surface at an angle that is approximately orthogonal to the surface, or incident light may strike a surface within a range of angles (e.g., within 45 degrees of orthogonal to the surface). Sources of incident light may include external light sources (e.g., ambient light) or internal light sources (e.g., light from a backlight or frontlight).

In particular embodiments, backlight 170 may be a substantially opaque or non-transparent illumination layer located behind LCD 140. In particular embodiments, backlight 170 may use one or more LEDs or fluorescent lamps to produce illumination for LCD 140. These illumination sources may be located directly behind LCD 140 or located on a side or edge of backlight 170 and directed to LCD 140 by one or more light guides, diffusers, or reflectors. In other particular embodiments, display 110 may include a frontlight (not illustrated in FIG. 7 or 8) instead of or in addition to backlight 170. As an example and not by way of limitation, a frontlight may be located between displays 140 and 150 or in front of front display 150, and the frontlight may provide illumination for LCD 140. In particular embodiments, a frontlight may include a substantially transparent layer that allows light to pass through the frontlight. Additionally, a frontlight may include illumination sources (e.g., LEDs) located at one or more edges, and the illumination sources may provide light to LCD 140 through reflection from one or more surfaces within the frontlight. Although this disclosure describes and illustrates particular frontlights and backlights having particular configurations, this disclosure contemplates any suitable frontlights and backlights having any suitable configurations.

FIG. 7 illustrates display 110 operating in a dynamic mode with LCD 140 showing an image which may be a digital picture or part of a video and may be displayed in vivid color using backlight 170 as an illumination source. When display 110 is operating in a dynamic mode, semi-static display 150 may be configured to be substantially transparent allowing light from backlight 170 and LCD 140 to pass through semi-static display 150 so the image from LCD 140 can be viewed. In particular embodiments, display 140 or 150 being substantially transparent may refer to display 140 or 150 transmitting greater than or equal to 70%, 80%, 90%, 95%, or 99% of incident visible light, or transmitting greater than or equal to any suitable percentage of incident visible light. As an example and not by way of limitation, when operating in a transparent mode, semi-static display 150 may transmit approximately 90% of visible light from LCD 140 to a viewing cone of display 110. FIG. 8 illustrates example display 110 of FIG. 7 operating in a semi-static mode with semi-static display 150 showing the time, date, and weather. In particular embodiments, when display 110 is operating in a semi-static mode, LCD 140 and backlight 170 may be inactive or turned off, and LCD 140 or backlight 170 may appear substantially transparent, substantially black (e.g., optically absorbing), or substantially white (e.g., optically reflecting or scattering). As an example and not by way of limitation, when in an off state, LCD 140 may be substantially transparent, and backlight 170 may appear substantially black. As another example and not by way of limitation, LCD 140 may have a partially reflective coating (e.g., on a front or rear surface) that causes LCD 140 to appear reflective or white when backlight 170 and LCD are turned off.

In particular embodiments, semi-static display 150 illustrated in FIGS. 7 and 8 may be a PDLC display, and dual-mode display 110 illustrated in FIGS. 7 and 8 may include a combination of LCD 140 (with backlight 170) and PDLC display 150. As illustrated in FIGS. 7 and 8, LCD 140 may be located behind PDLC display 150. As described in further detail below, PDLC display 150 may have pixels 160 configured to appear substantially transparent when a voltage is applied to pixel 160 and configured to appear substantially white or black when in an off state (e.g., no applied voltage). In FIG. 7, where display 110 is operating in a dynamic mode, pixels of PDLC display 150 are configured to appear substantially transparent so that LCD 140 may be viewed. In particular embodiments, and as illustrated in FIG. 8, when display 110 is operating in a semi-static mode, pixels of PDLC display 150 may be individually addressed (e.g., by a display controller) so that each pixel appears transparent or white. The pixels that form the text and the sun/cloud image displayed by PDLC display 150 in FIG. 8 may be configured to be substantially transparent. Those transparent pixels may appear dark or black since they show a black or optically absorbing surface of LCD 140 or backlight 170. The other pixels of PDLC display 150 may be configured to be in an off state to form a substantially white background. In other particular embodiments, when display 110 is operating in a semi-static mode, pixels of PDLC display 150 are addressed so that each pixel appears transparent or black. The pixels that form the text and the sun/cloud image may be configured to be substantially black (or, optically absorbing), while the pixels that form white background pixels of PDLC display 150 may be configured to be in an on state so they are substantially transparent. LCD 140 or backlight 170 may be configured to reflect or scatter incident light so that the corresponding transparent pixels of PDLC display 150 appear white.

In particular embodiments, semi-static display 150 illustrated in FIGS. 7 and 8 may be an electrochromic display, and dual-mode display 110 illustrated in FIGS. 7 and 8 may be a combination of LCD 140 (with backlight 170) and electrochromic display 150. As illustrated in FIGS. 7 and 8, LCD 140 may be located behind electrochromic display 150. As described in further detail below, electrochromic display 150 may have pixels 160 configured to appear substantially transparent or substantially blue, silver, black, or white, and the state of an electrochromic pixel may be changed (e.g., from transparent to white) by applying a burst of charge to the pixel's electrodes. In FIG. 7, where display 110 is operating in a dynamic mode, pixels of electrochromic display 150 are configured to appear substantially transparent so that LCD 140 may be viewed. In FIG. 8, where display 110 is operating in a semi-static mode, pixels of electrochromic display 150 are individually addressed (e.g., by a display controller) so that each pixel appears transparent or white. The pixels that form the text and the sun/cloud image displayed by electrochromic display 150 in FIG. 8 may be configured to be substantially transparent. Those transparent pixels may appear dark or black since they show a black or optically absorbing surface of LCD 140 or backlight 170. The other pixels of electrochromic display 150 may be configured to appear substantially white.

In particular embodiments, semi-static display 150 illustrated in FIGS. 7 and 8 may be an electro-dispersive display, and dual-mode display 110 illustrated in FIGS. 7 and 8 may include a combination of LCD 140 (with backlight 170) and electro-dispersive display 150. As illustrated in FIGS. 7 and 8, LCD 140 may be located behind electro-dispersive display 150. As described in further detail below, pixels 160 of electro-dispersive display 150 may appear substantially transparent, opaque, black, or white based on the color, movement, or location of small particles contained within pixels 160 of electro-dispersive display 150. The movement or location of the small particles within a pixel may be controlled by voltages applied to one or more electrodes of the pixel. In FIG. 7, where display 110 is operating in a dynamic mode, pixels of electro-dispersive display 150 are configured to appear substantially transparent so that LCD 140 may be viewed. In particular embodiments, and as illustrated in FIG. 8, when display 110 is operating in a semi-static mode, pixels of electro-dispersive display 150 may be individually addressed (e.g., by a display controller) so that each pixel appears transparent or white. The pixels that form the text and the sun/cloud image displayed by electro-dispersive display 150 in FIG. 8 may be configured to be substantially transparent. Those transparent pixels may appear dark or black since they show a black or optically absorbing surface of LCD 140 or backlight 170. The other pixels of electro-dispersive display 150 may be configured to appear substantially opaque or white (e.g., the small particles contained within the pixels may be white or reflective, and those particles may be located so that the pixels appear white). In other particular embodiments, when display 110 is operating in a semi-static mode, pixels that form the text and sun/cloud image displayed by electro-dispersive display 150 in FIG. 8 may be configured to be substantially dark or black (e.g., the small particles contained within the pixels may be black, and those particles may be located so that the pixels appear black). Additionally, the other pixels of electro-dispersive display 150 may be configured to be substantially transparent, and these transparent pixels may appear white by showing a white or reflective surface of LCD 140 or backlight 170. In particular embodiments, LCD 140 or backlight 170 may have a reflective or a partially reflective front coating, or LCD 140 or backlight 170 may be configured to appear white when inactive or turned off.

In particular embodiments, semi-static display 150 illustrated in FIGS. 7 and 8 may be an electrowetting display, and dual-mode display 110 illustrated in FIGS. 7 and 8 may include a combination of LCD 140 (with backlight 170) and electrowetting display 150. As illustrated in FIGS. 7 and 8, LCD 140 may be located behind electrowetting display 150.

As described in further detail below, electrowetting display 150 may have pixels 160 that each contain an electrowetting fluid that can be controlled to make the pixels 160 appear substantially transparent, opaque, black, or white. Based on one or more voltages applied to electrodes of an electrowetting pixel, the electrowetting fluid contained within the pixel can be moved to change the appearance of the pixel. In FIG. 7, where display 110 is operating in a dynamic mode, pixels of electrowetting display 150 are configured to appear substantially transparent so that light from LCD 140 may pass through electrowetting display 150 and be viewed from front of display device 100. In particular embodiments, and as illustrated in FIG. 8, when display 110 is operating in a semi-static mode, pixels of electrowetting display 150 may be individually addressed (e.g., by a display controller) so that each pixel appears transparent or white. The pixels that form the text and the sun/cloud image displayed by electrowetting display 150 in FIG. 8 may be configured to be substantially transparent. Those transparent pixels may appear dark or black since they show a black or optically absorbing surface of LCD 140 or backlight 170. The other pixels of electrowetting display 150 may be configured to appear substantially opaque or white (e.g., the electrowetting fluid may be white and may be located so the pixels appear white). In other particular embodiments, when display 110 is operating in a semi-static mode, pixels that form the text and sun/cloud image displayed by electro-dispersive display 150 in FIG. 8 may be configured to be substantially dark or black (e.g., the electrowetting fluid may be black or optically absorbing). Additionally, the other pixels of electro-dispersive display 150 may be configured to be substantially transparent, and these transparent pixels may appear white by showing a white or reflective surface of LCD 140 or backlight 170.

Figure 9:
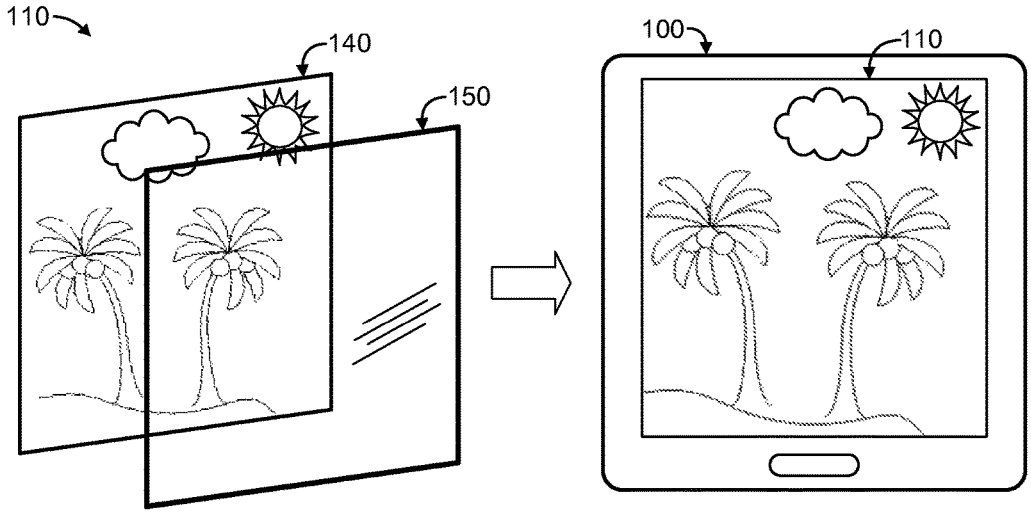
FIGS. 9 and 10 each illustrate an exploded view (on the left) of another example display and (on the right) a front view of an example display device with the example display.
Figure 10:
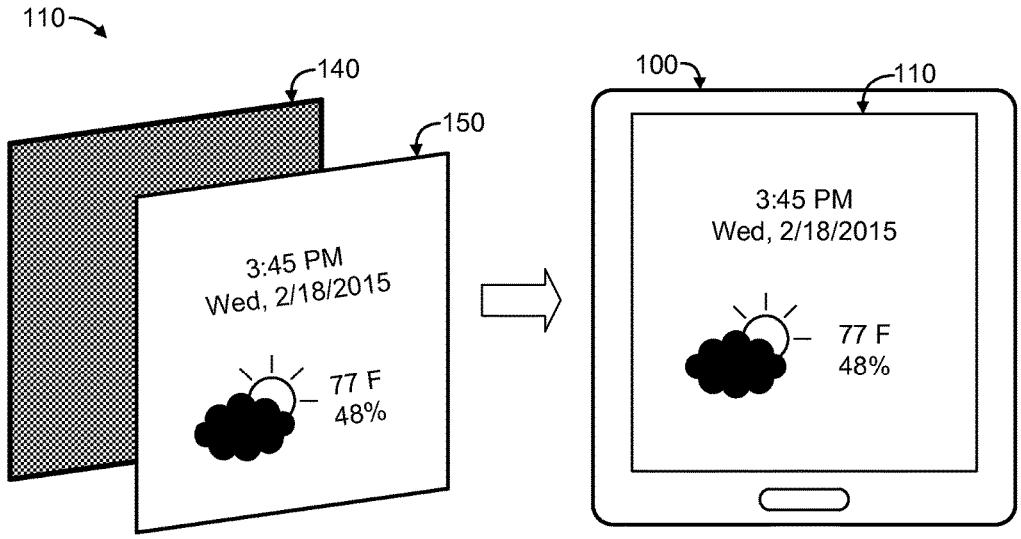

FIGS. 9 and 10 each illustrate an exploded view (on the left) of another example display 110 and (on the right) a front view of example display device 100 with the example display 110. In particular embodiments, display 110 may include front display 150 (which may be a semi-static, or non-emissive, display) and rear display 140 (which may be an emissive display, such as for example, an LED or an OLED display). In the example of FIG. 9, display 110 is operating in a dynamic mode and showing an image of a tropical scene, and in the example of FIG. 10, display 110 is operating in a semi-static mode. In FIGS. 9 and 10, rear display 140 may be an OLED display in which each pixel includes one or more films of organic compound that emit light in response to an electric current. As an example and not by way of limitation, each OLED pixel may include three or more subpixels, each subpixel including a particular organic compound configured to emit a particular color component (e.g., red, green, or blue) when an electric current is passed through the subpixel. When the red, green, and blue subpixels of an OLED pixel are each turned on by an equal amount, the pixel may appear white. When one or more subpixels of an OLED pixel are each turned on with a particular amount of current, the pixel may appear a particular color (e.g., red, green, yellow, orange, etc.). Although this disclosure describes and illustrates particular OLED displays configured to operate in particular manners, this disclosure contemplates any suitable OLED displays configured to operate in any suitable manner.

FIG. 9 illustrates display 110 operating in a dynamic mode with OLED display 140 showing an image which may be a digital picture or part of a video. When display 110 is operating in a dynamic mode, semi-static display 150 may be configured to be substantially transparent allowing light from OLED display 140 to pass through semi-static display 150 so the image from OLED display 140 can be viewed. FIG. 10 illustrates example display 110 of FIG. 9 operating in a semi-static mode with semi-static display 150 showing the time, date, and weather. In particular embodiments, when display 110 is operating in a semi-static mode, OLED display 140 may be inactive or turned off, and OLED display 140 may appear substantially transparent, substantially black (e.g., optically absorbing), or substantially white (e.g., optically reflecting or scattering). As an example and not by way of limitation, when turned off, OLED display 140 may absorb most light that is incident on its front surface, and OLED display 140 may appear dark or black. As another example and not by way of limitation, when turned off, OLED display 140 may reflect or scatter most incident light, and OLED display 140 may appear reflective or white.

In the example of FIGS. 9 and 10, front display 150 may be any suitable non-emissive (or, semi-static) display, such as for example, a PDLC display, an electrochromic display, an electro-dispersive display, or an electrowetting display. In FIGS. 9 and 10, front display 150 may be a PDLC display, an electrochromic display, an electro-dispersive display, or an electrowetting display, and the pixels of front display 150 may be configured to be substantially transparent when OLED display 140 is operating, allowing light emitted by OLED display 140 to pass through front display 150. In particular embodiments, and as illustrated in FIG. 10, when display 110 is operating in a semi-static mode, pixels of front display 150 (which may be a PDLC display, an electrochromic display, an electro-dispersive display, or an electrowetting display) may be individually addressed so that each pixel appears transparent or white. The pixels that form the text and the sun/cloud image displayed by front display 150 in FIG. 10 may be configured to be substantially transparent. Those transparent pixels may appear dark or black by showing a black or optically absorbing surface of OLED display 140. The other pixels of front display 150 may be configured to appear substantially opaque or white, forming the white background illustrated in FIG. 10. In other particular embodiments, when display 110 is operating in a semi-static mode, pixels of front display 150 (which may a PDLC display, an electrochromic display, an electro-dispersive display, or an electrowetting display) may be addressed so that each pixel appears transparent or black. The pixels that form the text and the sun/cloud image may be configured to be substantially black (or, optically absorbing), while the pixels that form white background pixels of front display 150 may be configured to be substantially transparent. OLED display 140 may be configured to reflect or scatter incident light so that the corresponding transparent pixels of front display 150 appear white.

Figure 11:
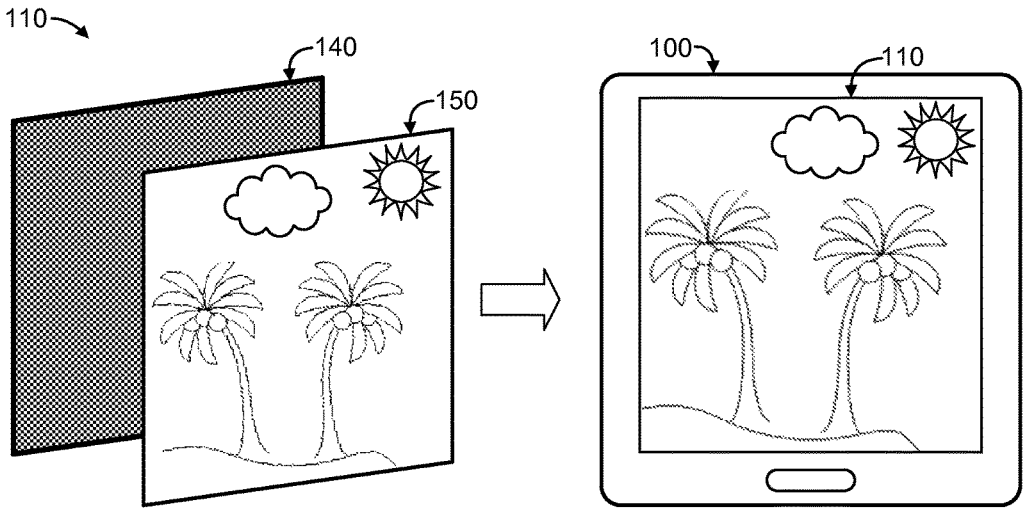
FIGS. 11 and 12 each illustrate an exploded view (on the left) of another example display and (on the right) a front view of an example display device with the example display.
Figure 12:
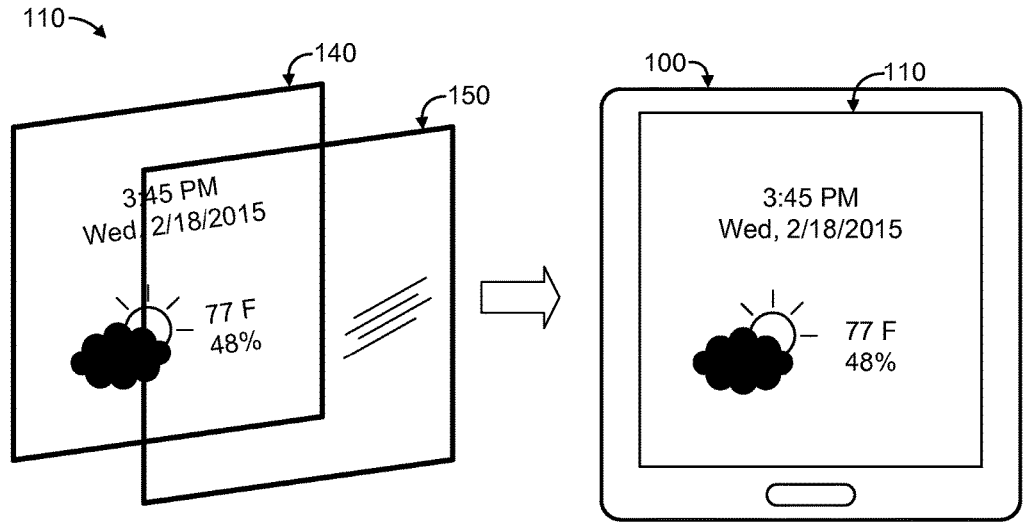

FIGS. 11 and 12 each illustrate an exploded view (on the left) of another example display 110 and (on the right) a front view of example display device 100 with the example display 110. In the examples of FIGS. 11 and 12, rear display 140 is an electrophoretic display. In particular embodiments, each pixel of electrophoretic display 140 may include a volume filled with a liquid in which white and black particles or capsules are suspended. The white and black particles may be electrically controllable, and by moving the particles within a pixel's volume, the pixel may be configured to appear white or black. As used herein, a white object (e.g., a particle or a pixel) may refer to an object that substantially reflects or scatters incident light or appears white, and a black object may refer to an object that substantially absorbs incident light or appears dark. In particular embodiments, the two colors of electrophoretic particles may each have a different affinity for positive or negative charges. As an example and not by way of limitation, the white particles may be attracted to positive charges or a positive side of an electric field, while the black particles may be attracted to negative charges or a negative side of an electric field. By applying an electric field orthogonal to a viewing surface of an electrophoretic pixel, either color of particles can be moved to the front surface of the pixel, while the other color is hidden from view in the back. As an example and not by way of limitation, a +5 V signal applied to an electrophoretic pixel may draw the white particles toward the front surface and cause the pixel to appear white. Similarly, a −5 V signal may draw the black particles toward the front surface of the pixel and cause the pixel to appear black.

In FIGS. 11 and 12, front display 150 is a transparent OLED display. In particular embodiments, a transparent OLED display may be an emissive display that is also substantially transparent. In particular embodiments, a transparent OLED display may refer to an OLED display that includes substantially transparent components. As an example and not by way of limitation, the cathode electrode of a transparent OLED pixel may be made from a semi-transparent metal, such as for example, a magnesium-silver alloy, and the anode electrode may be made from indium tin oxide (ITO). As another example and not by way of limitation, a transparent OLED pixel may include transparent thin-film transistors (TFTs) that may be made with a thin layer of zinc-tin-oxide. FIG. 11 illustrates display 110 operating in a dynamic (or, emissive) mode with transparent OLED display 150 showing an image or part of a video. When display 110 operates in a dynamic mode, electrophoretic display 140 may be configured to be substantially dark to provide a black background for the transparent OLED display 150 and improve the contrast of display 110. FIG. 12 illustrates display 110 operating in a semi-static mode. Transparent OLED display 150 is powered off and is substantially transparent, while the pixels of electrophoretic display 140 are configured to appear white or black to generate the text and image illustrated in FIG. 12.

Figure 13:
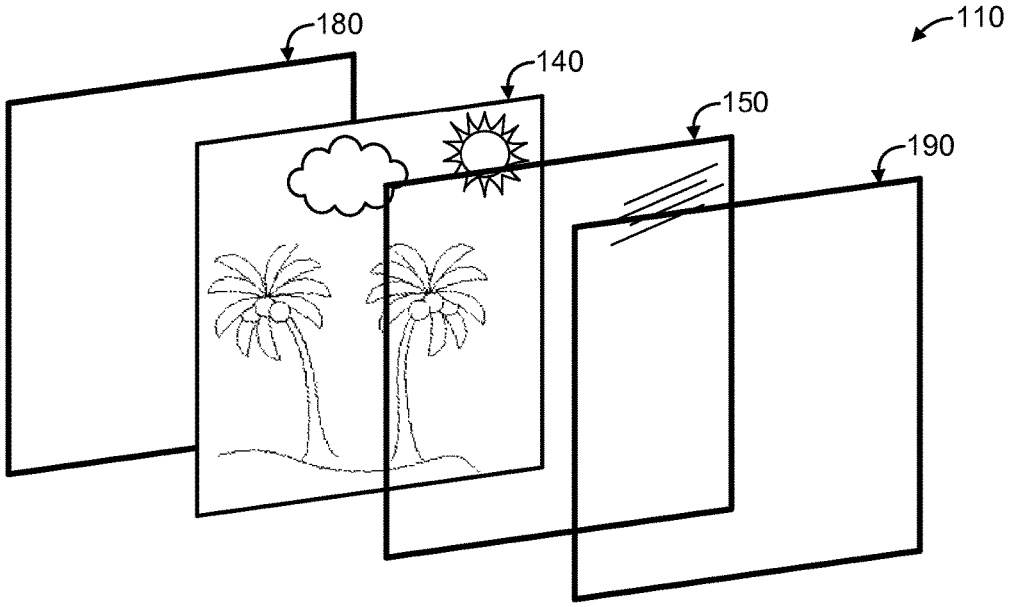
FIGS. 13 and 14 each illustrate an exploded view of another example display.
Figure 14:
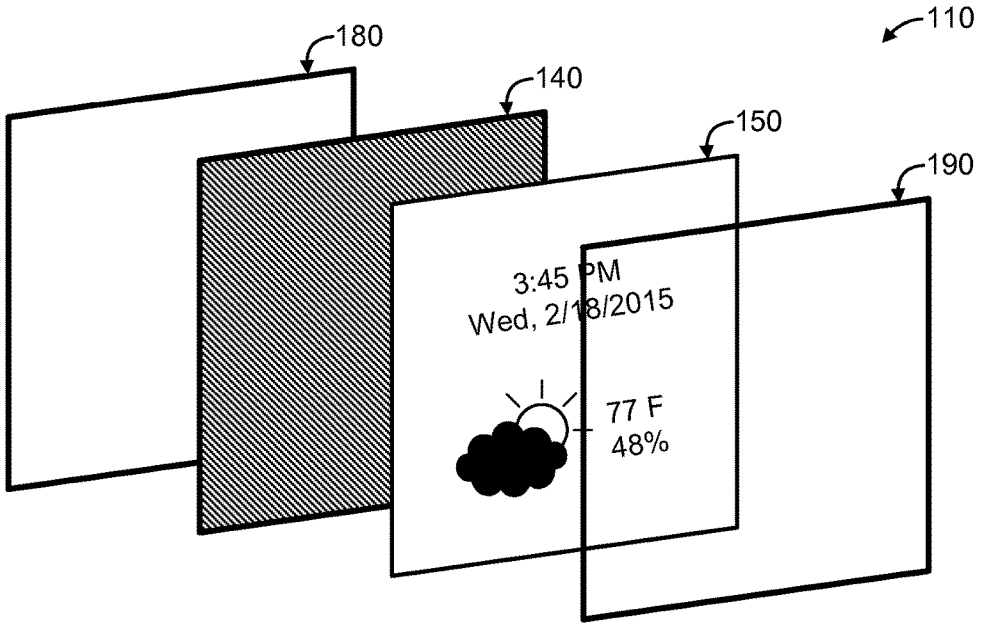

FIGS. 13 and 14 each illustrate an exploded view of another example display 110. In the example of FIG. 13, display 110 is operating in a dynamic mode and showing an image of a tropical scene, and in the example of FIG. 14, display 110 is operating in a semi-static mode. In particular embodiments, display 110 may include front display 150 (which may be a semi-static, or non-emissive display) and rear display 140 (which may be an LCD). In the example of FIGS. 13 and 14, front display 150 may be any suitable non-emissive (or, semi-static) display, such as for example, a PDLC display, an electrochromic display, an electro-dispersive display, or an electrowetting display. When display 110 is operating in a dynamic mode, semi-static display 150 may be configured to be substantially transparent allowing light from LCD 140 to pass through semi-static display 150 so the image from LCD 140 can be viewed.

In particular embodiments, and as illustrated in FIG. 14, when display 110 is operating in a semi-static mode, pixels of front display 150 (which may be a PDLC display, an electrochromic display, an electro-dispersive display, or an electrowetting display) may be individually addressed so that each pixel appears transparent or white. The pixels that form the text and the sun/cloud image displayed by front display 150 in FIG. 14 may be configured to be substantially transparent. Those transparent pixels may appear dark or black by showing a black or optically absorbing surface of LCD 140. The other pixels of front display 150 may be configured to appear substantially opaque or white, forming the white background illustrated in FIG. 14. In other particular embodiments, when display 110 is operating in a semi-static mode, pixels of front display 150 (which may a PDLC display, an electrochromic display, an electro-dispersive display, or an electrowetting display) may be addressed so that each pixel appears transparent or black. The pixels that form the text and the sun/cloud image may be configured to be substantially black (or, optically absorbing), while the pixels that form white background pixels of front display 150 may be configured to be substantially transparent. LCD 140 or surface 180 may be configured to reflect or scatter incident light so that the corresponding transparent pixels of front display 150 appear white.

In particular embodiments, display 110 may include back layer 180 located behind LCD 140, and back layer 180 may be a reflector or a backlight. As an example and not by way of limitation, back layer 180 may be a reflector, such as for example, a reflective surface (e.g., a surface with a reflective metal or dielectric coating) or an opaque surface configured to substantially scatter a substantial portion of incident light and appear white. In particular embodiments, display 110 may include semi-static display 150, LCD 140, and back layer 180, where back layer 180 is configured as a reflector that provides illumination for LCD 140 by reflecting ambient light to pixels of LCD 140. The light reflected by reflector 180 may be directed to pixels of LCD 140 which modulate the light from reflector 180 to generate images or text. In particular embodiments, display 110 may include frontlight 190 configured to provide illumination for LCD 140, where frontlight 190 includes a substantially transparent layer with illumination sources located on one or more edges of frontlight 190. As an example and not by way of limitation, display 110 may include LCD 140, semi-static display 150, reflector 180, and frontlight 190, where reflector 180 and frontlight 190 together provide illumination for LCD 140. Reflector 180 may provide illumination for LCD 140 by reflecting or scattering incident ambient light or light from frontlight 190 to pixels of LCD 140. If there is sufficient ambient light available to illuminate LCD 140, then frontlight 190 may be turned off or may operate at a reduced setting. If there is insufficient ambient light available to illuminate LCD 140 (e.g., in a darkened room), then frontlight 190 may be turned on to provide illumination, and the light from frontlight 190 may reflect off of reflector 180 and then illuminate pixels of LCD 140. In particular embodiments, an amount of light provided by frontlight 190 may be adjusted up or down based on an amount of ambient light present (e.g., frontlight may provide increased illumination as ambient light decreases). In particular embodiments, frontlight 190 may be used to provide illumination for semi-static display 150 if there is not enough ambient light present to be scattered or reflected by semi-static display 150. As an example and not by way of limitation, in a darkened room, frontlight 190 may be turned on to illuminate semi-static display 150.

In the example of FIGS. 13 and 14, back layer 180 may be a backlight configured to provide illumination for LCD 140. As an example and not by way of limitation, display 110 may include LCD 140, semi-static display 150, backlight 180, and frontlight 190. In particular embodiments, illumination for LCD 140 may be provided primarily by backlight 180, and frontlight 190 may be turned off when LCD 140 is operating. When display 110 is operating in a semi-static mode, backlight 180 may be turned off, and frontlight 190 may be turned off or may be turned on to provide illumination for semi-static display 150.

Figure 15:
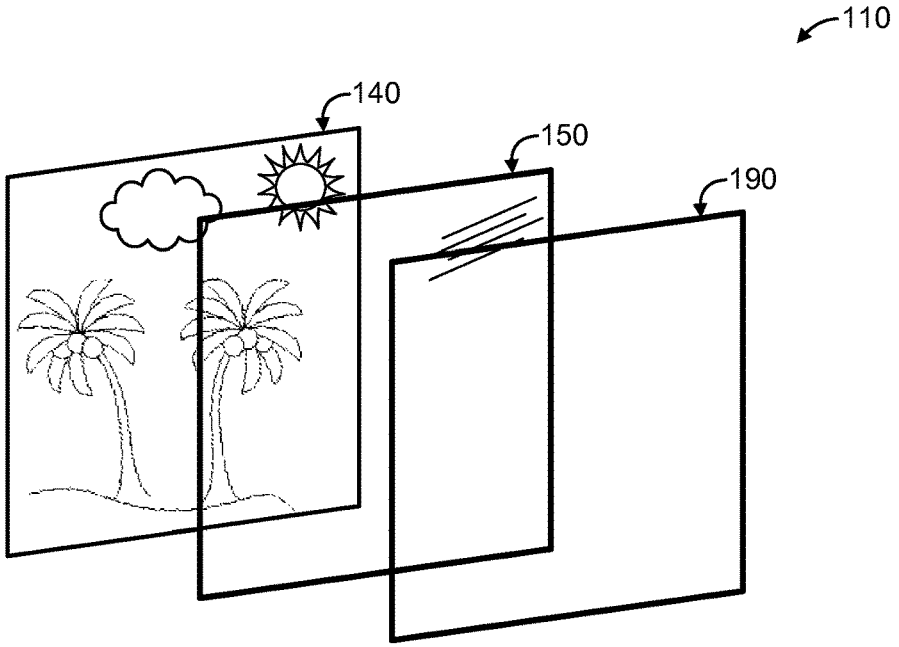
FIGS. 15 and 16 each illustrate an exploded view of another example display.
Figure 16:
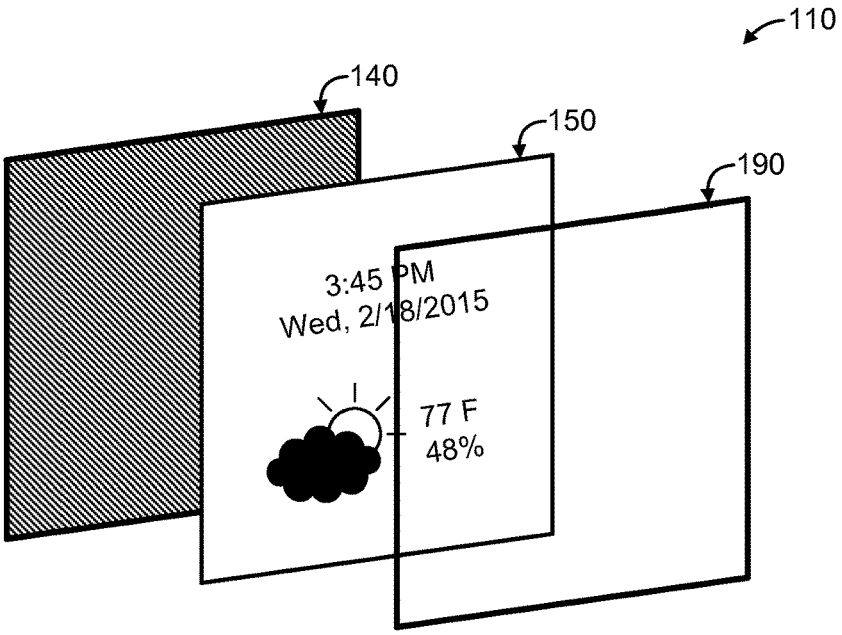

FIGS. 15 and 16 each illustrate an exploded view of another example display 110. In the example of FIG. 15, display 110 is operating in a dynamic mode and showing an image of a tropical scene, and in the example of FIG. 16, display 110 is operating in a semi-static mode. In particular embodiments, display 110 may include front display 150 (which may be a semi-static, or non-emissive, display) and rear display 140 (which may be an LED or OLED display). In the example of FIGS. 15 and 16, front display 150 may be any suitable non-emissive (or, semi-static) display, such as for example, a PDLC display, an electrochromic display, an electro-dispersive display, or an electrowetting display. In FIGS. 15 and 16, rear display 140 may be an OLED display, and when display 110 is operating in a dynamic mode, semi-static display 150 may be configured to be substantially transparent allowing light emitted by OLED display 140 to pass through semi-static display 150 so an image from OLED display 140 can be viewed.

In particular embodiments, and as illustrated in FIG. 16, when display 110 is operating in a semi-static mode, pixels of front display 150 (which may be a PDLC display, an electrochromic display, an electro-dispersive display, or an electrowetting display) may be individually addressed so that each pixel appears transparent or white, and OLED display 140 may be turned off and configured to appear substantially black. In other particular embodiments, when display 110 is operating in a semi-static mode, pixels of front display 150 may be addressed so that each pixel appears transparent or black, and OLED display 140 may be turned off and configured to appear substantially white. In particular embodiments and as illustrated in FIGS. 15 and 16, display 110 may include OLED display 140, semi-static display 150, and frontlight 190. In the example of FIG. 16, display 110 may include frontlight 190 to provide illumination for semi-static display 150 if there is not enough ambient light present to be scattered or reflected by semi-static display 150. When display 110 is operating in a semi-static mode, if there is sufficient ambient light available to illuminate semi-static display 150, then frontlight 190 may be turned off or may operate at a reduced setting. If there is insufficient ambient light available to illuminate semi-static display 150, then frontlight 190 may be turned on to provide illumination for semi-static display 150. In particular embodiments, an amount of light provided by frontlight 190 to semi-static display 150 may be adjusted up or down based on an amount of ambient light present.

Figure 17:
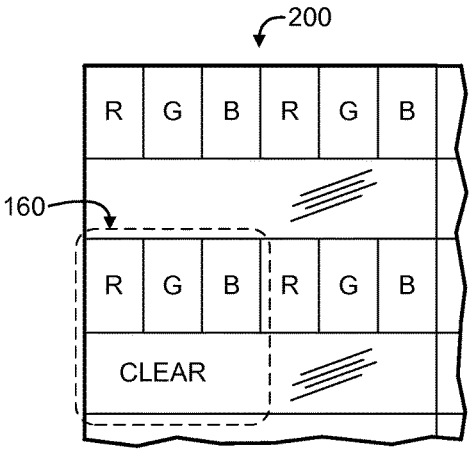
FIG. 17 illustrates a portion of an example partially emissive display.

FIG. 17 illustrates a portion of example partially emissive display 200. In particular embodiments, partially emissive display 200 may include partially emissive pixels 160, where each partially emissive pixel 160 includes one or more substantially transparent regions and one or more addressable regions configured to modulate or emit visible light. In the example of FIG. 17, a dashed line encompasses example partially emissive pixel 160, which includes a substantially transparent region (labeled "CLEAR") and an addressable region that includes a red ("R"), green ("G"), and blue ("B") subpixel. In particular embodiments, partially emissive display 200 may be a partially emissive LCD, and partially emissive LCD pixel 160 may include LCD subpixels, where each LCD subpixel is configured to modulate a particular color component (e.g., red, green, or blue). In other particular embodiments, partially emissive display 200 may be a partially emissive LED or OLED display with partially emissive LED or OLED pixels 160, respectively. Each partially emissive LED or OLED pixel 160 may include subpixels, each subpixel configured to emit a particular color component (e.g., red, green, or blue). In particular embodiments, transparent regions and addressable regions may occupy any suitable fraction of an area of partially emissive pixel 160. As an example and not by way of limitation, transparent regions may occupy ¼, ⅓, ½, ⅔, ¾, or any suitable fraction of the area of partially emissive pixel 160. Similarly, addressable regions may occupy ¼, ⅓, ½, ⅔, ¾, or any suitable fraction of the area of partially emissive pixel 160. In the example of FIG. 17, transparent regions and addressable regions each occupy approximately one half of the area of partially emissive pixel 160. In particular embodiments, a partially emissive display may be referred to as a partial display, and a partially emissive LCD or OLED display may be referred to as a partial LCD or a partial OLED display, respectively. Additionally, a partially emissive pixel may be referred to as a partial pixel, and a partially emissive LCD or OLED pixel may be referred to as a partial LCD pixel or a partial OLED pixel, respectively.

Figure 18A:
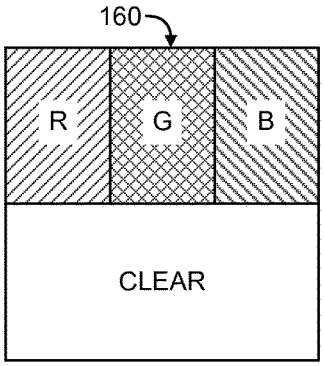
FIGS. 18A-18E illustrate example partially emissive pixels.
Figure 18B:
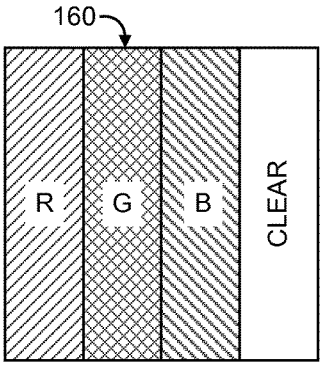
Figure 18C:
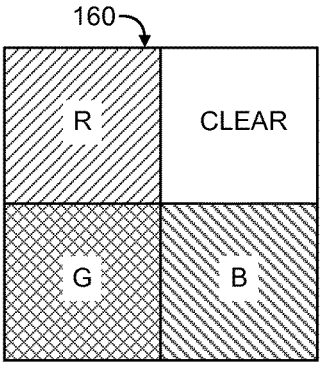
Figure 18D:
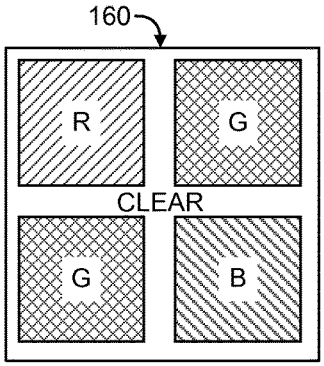
Figure 18E:
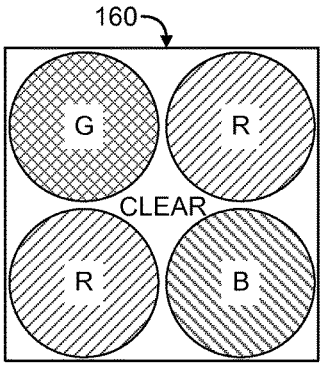

FIGS. 18A-18E illustrate example partially emissive pixels 160. In particular embodiments, partially emissive pixels 160 may have any suitable shape, such as for example, square, rectangular, or circular. The example partially emissive pixels 160 illustrated in FIGS. 18A-18E have subpixels and transparent regions with various arrangements, shapes, and sizes. FIG. 18A illustrates partially emissive pixel 160 similar to the partially emissive pixel 160 illustrated in FIG. 17. In FIG. 18A, partially emissive pixel 160 includes three adjacent rectangular subpixels ("R," "G," and "B") and a transparent region located below the three subpixels, the transparent region having approximately the same size as the three subpixels. In FIG. 18B, partially emissive pixel 160 includes three adjacent rectangular subpixels and a transparent region located adjacent to the blue subpixel, the transparent region having approximately the same size and shape as each of the subpixels. In FIG. 18C, partially emissive pixel 160 is subdivided into four quadrants with three subpixels occupying three of the quadrants and the transparent region located in a fourth quadrant. In FIG. 18D, partially emissive pixel 160 has four square-shaped subpixels with the transparent region located in between and around the four subpixels. In FIG. 18E, partially emissive pixel 160 has four circular subpixels with the transparent region located in between and around the four subpixels. Although this disclosure describes and illustrates particular partially emissive pixels having particular subpixels and transparent regions with particular arrangements, shapes, and sizes, this disclosure contemplates any suitable partially emissive pixels having any suitable subpixels and transparent regions with any suitable arrangements, shapes, and sizes.

FIGS. 19-23 each illustrate an exploded view of example display 110. The example displays 110 in FIGS. 19-23 each include a partially emissive display configured as a front display 150 or a rear display 140. In particular embodiments, a partially emissive display may function as an emissive display, and additionally, the transparent regions of a partially emissive display may allow a portion of ambient light or light from a frontlight or backlight to be transmitted through a partially emissive display. In particular embodiments, ambient light (e.g., light from one or more sources located outside of display 110) may pass through transparent regions of a partially emissive display, and the ambient light may be used to illuminate pixels of the partially emissive display or pixels of another display (e.g., an electrophoretic display).

In particular embodiments, display 110 may include a partially transparent display configured as a front display 150 or a rear display 140. Each pixel of a partially transparent display may have one or more semi-static, addressable regions that may be configured to appear white, black, or transparent. Additionally, each pixel of a partially transparent display may have one or more substantially transparent regions that allow ambient light or light from a frontlight or backlight to pass through. As an example and not by way of limitation, a partially transparent electrophoretic display may function as a semi-static display with pixels that may be configured to appear white or black. Additionally, each pixel of a partially transparent electrophoretic display may have one or more transparent regions (similar to the partially emissive pixels described above) which may transmit a portion of ambient light or light from a frontlight or backlight. In particular embodiments, display 110 may include a partially emissive display and a partially transparent electrophoretic display, and pixels of the two displays may be aligned with respect to each other so their respective addressable regions are substantially non-overlapping and their respective transparent regions are substantially non-overlapping. As an example and not by way of limitation, a transparent region of a partially emissive pixel may transmit light that illuminates an electrophoretic region of a partially transparent pixel, and similarly, a transparent region of a partially transparent pixel may transmit light that illuminates the subpixels of a partially emissive LCD pixel. In particular embodiments, a partially transparent electrophoretic display may be referred to as a partial electrophoretic display.

In particular embodiments, display 110 may include a segmented backlight with regions configured to produce illumination light and other regions configured to not produce light. In particular embodiments, a segmented backlight may be aligned with respect to a partial LCD so that the light-producing regions of the segmented backlight are aligned to illuminate the subpixels of the partial LCD. As an example and not by way of limitation, a segmented backlight may produce light in strips, and each strip of light may be aligned to illuminate a corresponding strip of subpixels of a partial LCD. Although this disclosure describes and illustrates particular displays that include particular combinations of partially emissive displays, partially transparent displays, and segmented backlights, this disclosure contemplates any suitable displays that include any suitable combinations of partially emissive displays, partially transparent displays, or segmented backlights.

Figure 19:
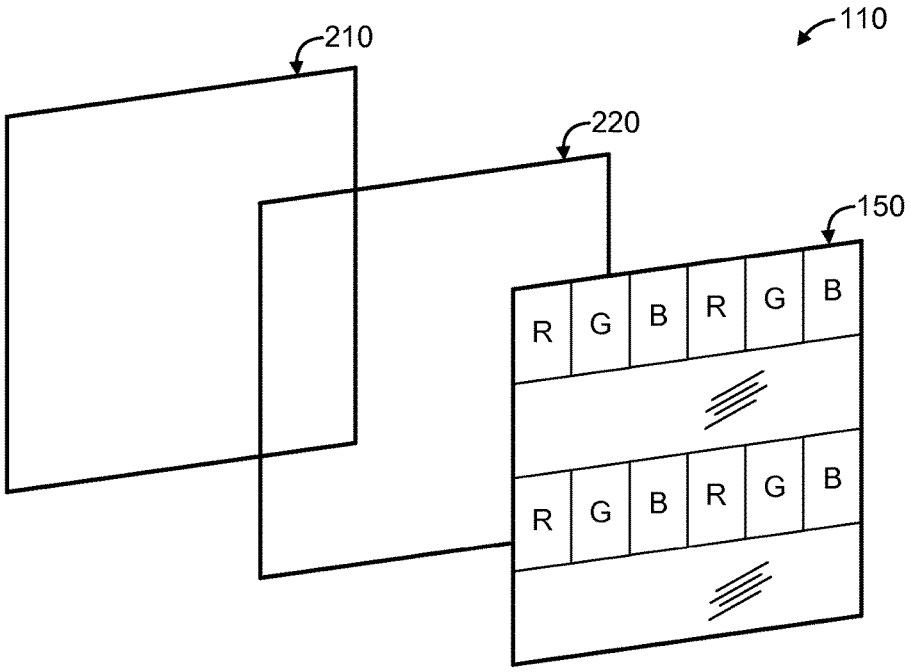
FIGS. 19-23 each illustrate an exploded view of an example display.

The example display 110 in FIG. 19 includes partial LCD 150, layer 210, and layer 220. In the example of FIG. 19, layer 210 may be a reflector (e.g., a reflective surface configured to reflect incident light), and layer 220 may be a frontlight. As an example and not by way of limitation, a reflector may reflect approximately 70%, 80%, 90%, 95%, or any suitable percentage of incident light. When display 110 in FIG. 19 is operating in an emissive mode, frontlight 220 is turned on and illuminates reflector 210, and reflector 210 reflects the light from frontlight 190 to partial LCD 150, which modulates the light to emit an image, a video, or other content. In an emissive mode, ambient light (that is transmitted through transparent regions of display 150) may also be used to illuminate partial LCD 150. When display 110 is operating in a semi-static mode, frontlight 220 is powered off, and ambient light (e.g., room light or sunlight) passes through the transparent regions of partial LCD 150. The ambient light passes through frontlight 220, which is substantially transparent, and reflects off of reflector 210. The reflected light illuminates partial LCD 150, which modulates the light to produce text, an image, or other content. In a non-emissive mode, display 110 may require little electrical power since frontlight is powered off and partial LCD 150 may not require significant power to operate.

In other particular embodiments, in FIG. 19, layer 210 may be a backlight, and layer 220 may be a transflector located between backlight 210 and partial LCD 150. A transflector may refer to a layer that partially reflects and partially transmits incident light. As examples and not by way of limitation, a transflector may include a glass substrate with a reflective coating covering portions of the substrate, a half-silvered mirror that is partially transmissive and partially reflective, or a wire-grid polarizer. In particular embodiments, a transflector may transmit or reflect any suitable fraction of incident light. As an example and not by way of limitation, transflector 220 may reflect approximately 50% of incident light and may transmit approximately 50% of incident light. In the example of FIG. 19, when display 110 is operating in an emissive mode, backlight 210 may be turned on and may send light through transflector 220 to illuminate partial LCD 150. In particular embodiments, the light from backlight 210 may be reduced or turned off if there is sufficient ambient light available to illuminate partial LCD 150. When display 110 is operating in a semi-static mode, backlight 210 may be turned off, and transflector 220 may illuminate partial LCD 150 by reflecting ambient light to partial LCD 150. Ambient light (e.g., light originating from outside display 110) may be transmitted into display 110 via transparent regions of partial LCD 150.

Figure 20:
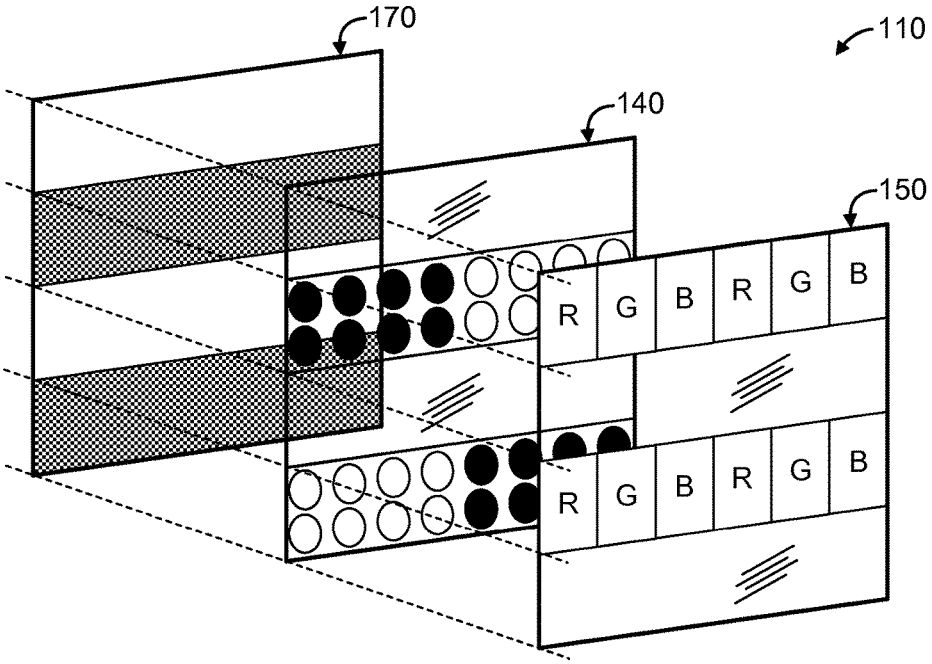

In the example of FIG. 20, front display 150 is a partially emissive LCD, and rear display 140 is a partially transparent electrophoretic display with pixels configured to appear white or black. The example display 110 in FIG. 20 includes partial LCD 150, partial electrophoretic display 140, and segmented backlight 170. In particular embodiments, the pixels of partial LCD 150 and partial electrophoretic display 140 may be the same size, and the pixels may be aligned with respect to one another. The pixels may be aligned so that their borders are situated directly over or under one another and so that the transparent regions of pixels of one display are superposed with the addressable regions of pixels of the other display, and vice versa. When display 110 in FIG. 20 is operating in an emissive mode, segmented backlight 170 is turned on, and the lighted strips of segmented backlight 170 produce light that propagates through transparent regions of partial electrophoretic display 140 and illuminates the subpixels of partial LCD 150, which modulates the light to produce an image or other content. The darker regions of segmented backlight 170 do not produce light. When display 110 is operating in an emissive mode, the pixels of partial electrophoretic display 140 may be configured to appear white or black. When display 110 is operating in a semi-static mode, segmented backlight 170 and partial LCD 150 are powered off, and ambient light passes through the transparent regions of partial LCD 150 to illuminate the addressable regions of the pixels of partial electrophoretic display 140. Each pixel of partial electrophoretic display 140 may be configured to appear white or black so that partial electrophoretic display 140 produces text, an image, or other content.

Figure 21:
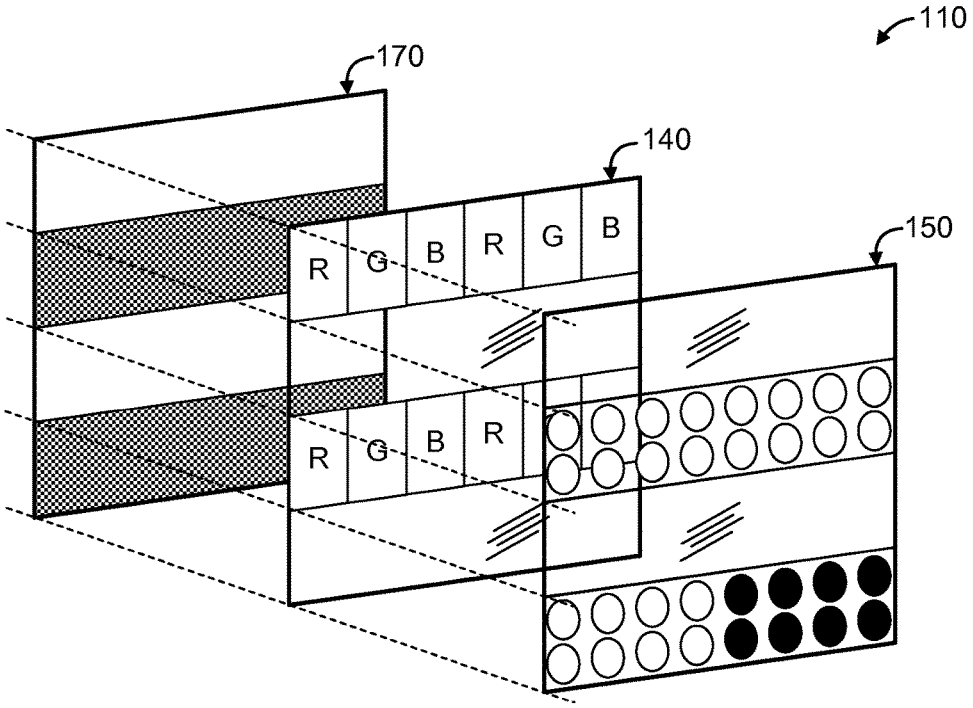

In the example of FIG. 21, rear display 140 is a partially emissive LCD, and front display 150 is a partially transparent electrophoretic display with pixels configured to appear white or black. The example display 110 in FIG. 21 includes partial LCD 140, partial electrophoretic display 150, and segmented backlight 170. In particular embodiments, the pixels of partial LCD 140 and partial electrophoretic display 150 may be the same size, and the pixels (and their respective transparent regions and addressable regions) may be aligned with respect to one another. When display 110 in FIG. 21 is operating in an emissive mode, segmented backlight 170 is turned on, and the lighted strips of segmented backlight 170 produce light that illuminates the subpixels of partial LCD 140. The subpixels modulate the light to produce an image or other content, which propagates through the transparent regions of partial electrophoretic display 150. The darker regions of segmented backlight 170 do not produce light. When display 110 is operating in an emissive mode, the pixels of partial electrophoretic display 150 may be configured to appear white or black. When display 110 is operating in a semi-static mode, segmented backlight 170 and partial LCD 150 are powered off, and ambient light illuminates the addressable regions of the pixels of partial electrophoretic display 150. Ambient light that propagates through the transparent regions of partial electrophoretic display 150 may be absorbed or reflected by the subpixels of partial LCD 140.

Figure 22:
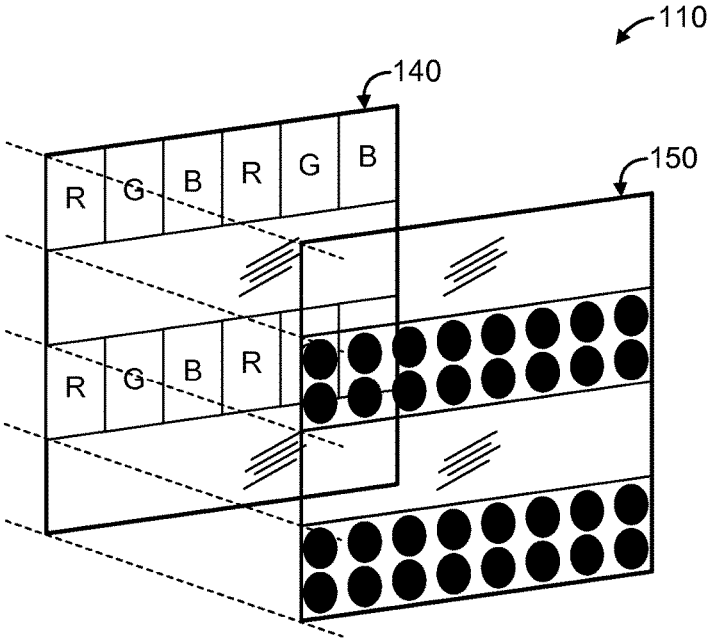

In the example of FIG. 22, rear display 140 is a partially emissive OLED display, and front display 150 is a partially transparent electrophoretic display. The example display 110 in FIG. 22 includes partial OLED display 140 and partial electrophoretic display 150. In particular embodiments, the pixels of partial OLED display 140 and partial electrophoretic display 150 may be the same size, and the pixels (and their respective transparent and addressable regions) may be aligned with respect to one another. When display 110 in FIG. 22 is operating in an emissive mode, the subpixels of partial OLED display 140 may emit light that propagates through the transparent regions of partial electrophoretic display 150. When display 110 is operating in an emissive mode, the pixels of partial electrophoretic display 150 may be configured to appear white or black. When display 110 is operating in a semi-static mode, partial OLED display 140 may be powered off, and ambient light illuminates the addressable regions of the pixels of partial electrophoretic display 150, which are each configured to appear black or white. Ambient light that propagates through the transparent regions of partial electrophoretic display 150 may be absorbed, scattered, or reflected by the subpixels of partial OLED display 140.

Figure 23:
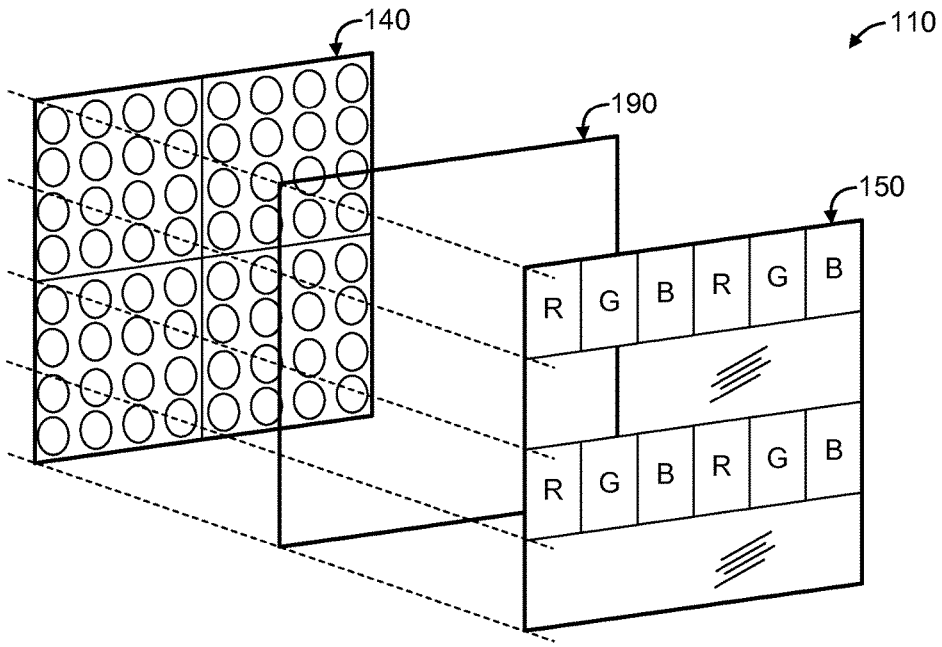

In the example of FIG. 23, rear display 140 is an electrophoretic display, and front display 150 is a partially transparent LCD 150. The example display 110 in FIG. 23 includes electrophoretic display 140, frontlight 190, and partial LCD 150. In particular embodiments, electrophoretic display 140 may be a partial electrophoretic display or (as illustrated in FIG. 23) may be an electrophoretic display with little or no transparent regions. In particular embodiments, the pixels of electrophoretic display 140 and partial LCD 150 may be aligned with respect to one another. When display 110 in FIG. 22 is operating in an emissive mode, backlight 190 may be turned on to illuminate electrophoretic display 140, and electrophoretic display 140 may be configured so that its pixels are white so they scatter or reflect the light from the backlight forward to partial LCD 150. The subpixels of partial LCD 150 modulate the incident light scattered by electrophoretic display 140 to produce an image or other content. When display 110 is operating in a semi-static mode, backlight 190 and partial LCD 150 may be powered off. Electrophoretic display 140 is illuminated by ambient light that is transmitted through the transparent regions of partial LCD 150 and through frontlight 190. The pixels of electrophoretic display 140 are configured to appear white or black to generate text or an image that propagates through frontlight 190 and the transparent regions of partial LCD 150.

In particular embodiments, a display screen may be incorporated into an appliance (e.g., in a door of a refrigerator) or part of an automobile (e.g., in a windshield or mirror of a car). As an example and not by way of limitation, a display screen may be incorporated into an automobile windshield to provide overlaid information over a portion of the windshield. In one mode of operation, the display screen may be substantially transparent, and in another mode of operation, the display screen pixels may be configured to display information that may be viewed by a driver or passenger. In particular embodiments, a display screen may include multiple pixels, where each pixel may be configured to be substantially transparent to incident light or to be at least partially opaque or substantially opaque to incident light. As an example and not by way of limitation, a semi-static display may include multiple semi-static pixels, where the semi-static pixels may be configured to be substantially transparent or opaque. In particular embodiments, a display screen configured to operate in two or more modes, where one of the modes includes pixels of the display screen appearing transparent, may be referred to as a display with high transparency. In particular embodiments, when a pixel is in a mode in which it is substantially transparent to visible light, the pixel may not: emit or generate visible light; modulate one or more frequencies (i.e., colors) of visible light; or both In particular embodiments, a material or pixel that is at least partially opaque may refer to a material or pixel that is partially transparent to visible light and partially reflects, scatters, or absorbs visible light. As an example and not by way of limitation, a pixel that is partially opaque may appear partially transparent and partially black or white. A material or pixel that is substantially opaque may be a material or pixel that reflects, scatters, or absorbs substantially all incident visible light and transmits little or no light. In particular embodiments, scattering or reflection of light from an opaque material may refer to a specular reflection, a diffuse reflection (e.g., scattering incident light in many different directions), or a combination of specular and diffuse reflections. As examples and not by way of limitation, an opaque material that is substantially absorbing may appear black, and an opaque material that scatters or reflects substantially all incident light may appear white.

Figure 24A:
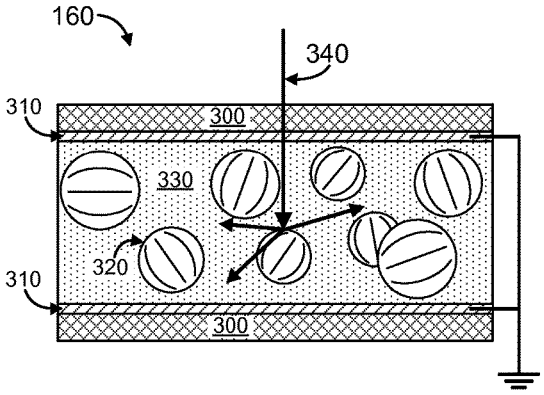
FIGS. 24A-24B each illustrate a side view of an example polymer-dispersed liquid-crystal (PDLC) pixel.
Figure 24B:
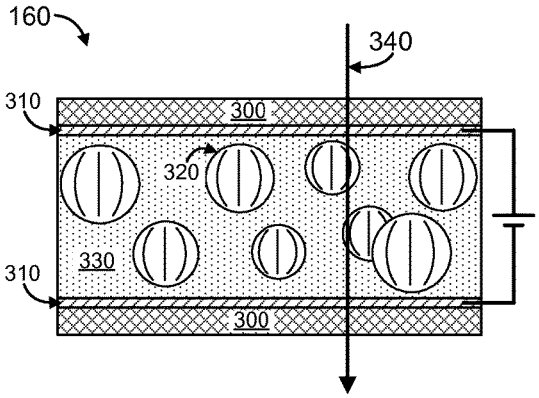

FIGS. 24A-24B each illustrate a side view of example polymer-dispersed liquid-crystal (PDLC) pixel 160. In particular embodiments, a PDLC display may include multiple PDLC pixels 160 arranged to form a display screen, where each PDLC pixel 160 may be individually addressable (e.g., using an active-matrix or a passive-matrix scheme). In the examples of FIGS. 24A and 24B, PDLC pixel 160 includes substrates 300 (e.g., a thin sheet of transparent glass or plastic), electrodes 310, liquid-crystal (LC) droplets 320, and polymer 330. Electrodes 310 are substantially transparent and may be made of a thin film of transparent material, such as for example ITO, which is deposited onto a surface of substrate 300. LC droplets 320 are suspended in a solidified polymer 330, where the concentrations of LC droplets 320 and polymer 330 may be approximately equal. In particular embodiments, PDLC pixel 160 may be substantially opaque when little or no voltage is applied between electrodes 310 (e.g., pixel 160 may appear white or black), and PDLC pixel 160 may be substantially transparent when a voltage is applied between electrodes 310. In FIG. 24A, when the two electrodes 310 are coupled together so there is little or no voltage or electric field between the electrodes, incident light ray 340 is blocked by randomly oriented LC droplets 320 that may scatter or absorb light ray 340. In this "off" state, PDLC pixel 160 is substantially opaque or non-transmissive and may appear white (e.g., by scattering most of the incident light) or black (e.g., by absorbing most of the incident light). In FIG. 24B, when a voltage (e.g., 5 V) is applied between electrodes 310, the resulting electric field causes LC droplets 320 to align so that incident light ray 340 is transmitted through PDLC pixel 160. In this "on" state, PDLC pixel 160 may be at least partially transparent. In particular embodiments, the amount of transparency of PDLC pixel 160 may be controlled by adjusting the applied voltage (e.g., a higher applied voltage results in a higher amount of transparency). As an example and not by way of limitation, PDLC pixel 160 may be 50% transparent (e.g., may transmit 50% of incident light) with an applied voltage of 2.5 V, and PDLC pixel 160 may be 90% transparent with an applied voltage of 5 V.

In particular embodiments, a PDLC material may be made by adding high molecular-weight polymers to a low-molecular weight liquid crystal. Liquid crystals may be dissolved or dispersed into a liquid polymer followed by a solidification process (e.g., polymerization or solvent evaporation). During the change of the polymer from liquid to solid, the liquid crystals may become incompatible with the solid polymer and form droplets (e.g., LC droplets 320) dispersed throughout the solid polymer (e.g., polymer 330). In particular embodiments, a liquid mix of polymer and liquid crystals may be placed between two layers, where each layer includes substrate 300 and electrode 310. The polymer may then be cured, thereby forming a sandwich structure of a PDLC device as illustrated in FIGS. 24A-24B.

A PDLC material may be considered part of a class of materials referred to as liquid-crystal polymer composites (LCPCs). A PDLC material may include about the same relative concentration of polymer and liquid crystals. Another type of LCPC is polymer-stabilized liquid crystal (PSLC), in which concentration of the polymer may be less than 10% of the LC concentration. Similar to a PDLC material, a PSLC material also contains droplets of LC in a polymer binder, but the concentration of the polymer is considerably less than the LC concentration. Additionally, in a PSLC material, the LCs may be continuously distributed throughout the polymer rather than dispersed as droplets. Adding the polymer to an LC to form a phase-separated PSLC mixture creates differently oriented domains of the LC, and light may be scattered from these domains, where the size of the domains may determine the strength of scattering. In particular embodiments, a pixel 160 may include a PSLC material, and in an "off" state with no applied electric field, a PSLC pixel 160 may appear substantially transparent. In this state, liquid crystals near the polymers tend to align with the polymer network in a stabilized configuration. A polymer-stabilized homogeneously aligned nematic liquid crystal allows light to pass through without being scattered because of the homogeneous orientation of both polymer and LC. In an "on" state with an applied electric field, a PSLC pixel 160 may appear substantially opaque. In this state, the electric field applies a force on the LC molecules to align with the vertical electric field. However, the polymer network tries to hold the LC molecules in a horizontal homogeneous direction. As a result, a multi-domain structure is formed where LCs within a domain are oriented uniformly, but the domains are oriented randomly. In this state, incident light encounters the different indices of refraction of the domains and the light is scattered. Although this disclosure describes and illustrates particular polymer-stabilized liquid crystal materials configured to form particular pixels having particular structures, this disclosure contemplates any suitable polymer-stabilized liquid crystal materials configured to form any suitable pixels having any suitable structures.

Figure 25:
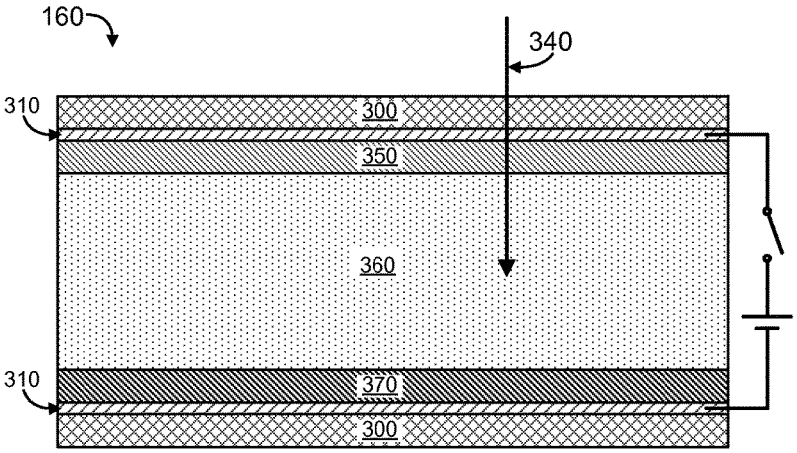
FIG. 25 illustrates a side view of an example electrochromic pixel.

FIG. 25 illustrates a side view of example electrochromic pixel 160. In particular embodiments, an electrochromic display may include electrochromic pixels 160 arranged to form a display screen, where each electrochromic pixel 160 may be individually addressable (e.g., using an active-matrix or a passive-matrix scheme). In the example of FIG. 25, electrochromic pixel 160 includes substrates 300 (e.g., a thin sheet of transparent glass or plastic), electrodes 310, ion storage layer 350, ion conductive electrolyte 360, and electrochromic layer 370. Electrodes 310 are substantially transparent and may be made of a thin film of ITO, which is deposited onto a surface of substrate 300. Electrochromic layer 370 includes a material that exhibits electrochromism (e.g., tungsten oxide, nickel-oxide materials, or polyaniline), where electrochromism refers to a reversible change in color when a burst of electric charge is applied to a material. In particular embodiments, in response to an applied charge or voltage, electrochromic pixel 160 may change between a substantially transparent state (e.g., incident light 340 propagates through electrochromic pixel 160) and an opaque, colored, or translucent state (e.g., incident light 340 may be partially absorbed, filtered, or scattered by electrochromic pixel 160). In particular embodiments, in an opaque, colored, or translucent state, electrochromic pixel 160 may appear blue, silver, black, white, or any other suitable color. Electrochromic pixel 160 may change from one state to another when a burst of charge or voltage is applied to electrodes 310 (e.g., switch in FIG. 25 may be closed momentarily to apply a momentary voltage between electrodes 310). In particular embodiments, once a state of electrochromic pixel 160 has been changed with a burst of charge, electrochromic pixel 160 may not require any power to maintain its state, and so, electrochromic pixel 160 may only require power when changing between states. As an example and not by way of limitation, once the electrochromic pixels 160 of an electrochromic display have been configured (e.g., to be either transparent or white) so the display shows some particular information (e.g., an image or text), the displayed information can be maintained in a static mode without requiring any power or refresh of the pixels.

Figure 26:
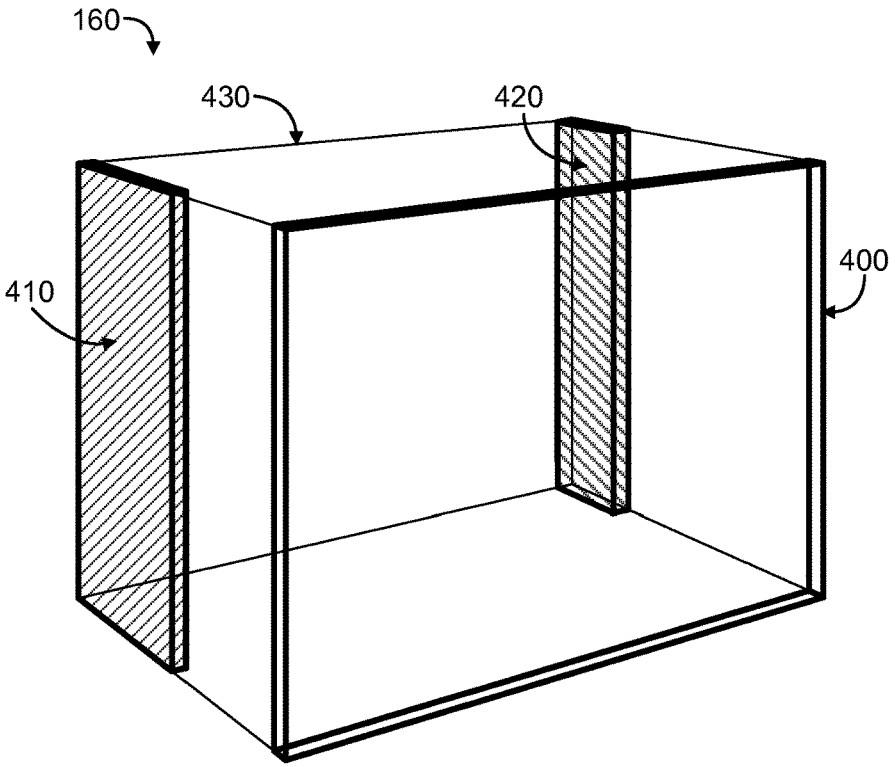
FIG. 26 illustrates a perspective view of an example electro-dispersive pixel.

FIG. 26 illustrates a perspective view of example electro-dispersive pixel 160. In particular embodiments, an electro-dispersive display may include multiple electro-dispersive pixels 160 arranged to form a display screen, where each electro-dispersive pixel 160 may be individually addressable (e.g., using an active-matrix or a passive-matrix scheme). As an example and not by way of limitation, electro-dispersive pixel 160 may include two or more electrodes to which voltages may be applied through an active or passive matrix. In particular embodiments, electro-dispersive pixel 160 may include front electrode 400, attractor electrode 410, and pixel enclosure 430. Front electrode 400 may be oriented substantially parallel to a viewing surface of the display screen, and front electrode 400 may be substantially transparent to visible light. As an example and not by way of limitation, front electrode 400 may be made of a thin film of ITO, which may be deposited onto a front or back surface of pixel enclosure 430. Attractor electrode 410 may be oriented at an angle with respect to front electrode 400. As an example and not by way of limitation, attractor electrode 410 may be approximately orthogonal to front electrode 400

(e.g., oriented at approximately 90 degrees with respect to front electrode 400). In particular embodiments, electro-dispersive pixel 160 may also include disperser electrode 420 disposed on a surface of enclosure 430 opposite attractor electrode 410. Attractor electrode 410 and disperser electrode 420 may each be made of a thin film of ITO or a thin film of other conductive material (e.g., gold, silver, copper, chrome, or a conductive form of carbon).

In particular embodiments, pixel enclosure 430 may be located at least in part behind or in front of front electrode 400. As an example and not by way of limitation, enclosure 430 may include several walls that contain an interior volume bounded by the walls of enclosure 430, and one or more electrodes may be attached to or deposited on respective surfaces of walls of enclosure 430. As an example and not by way of limitation, front electrode 400 may be an ITO electrode deposited on an interior surface (e.g., a surface that faces the pixel volume) or an exterior surface of a front or back wall of enclosure 430. In particular embodiments, front or back walls of enclosure 430 may refer to layers of pixel 160 that incident light may travel through when interacting with pixel 160, and the front or back walls of enclosure 430 may be substantially transparent to visible light. Thus, in particular embodiments, pixel 160 may have a state or mode in which it is substantially transparent to visible light and does not: emit or generate visible light; modulate one or more frequencies (i.e., colors) of visible light; or both. As another example and not by way of limitation, attractor electrode 410 or disperser electrode 420 may each be attached to or deposited on an interior or exterior surface of a side wall of enclosure 430.

Figure 27:
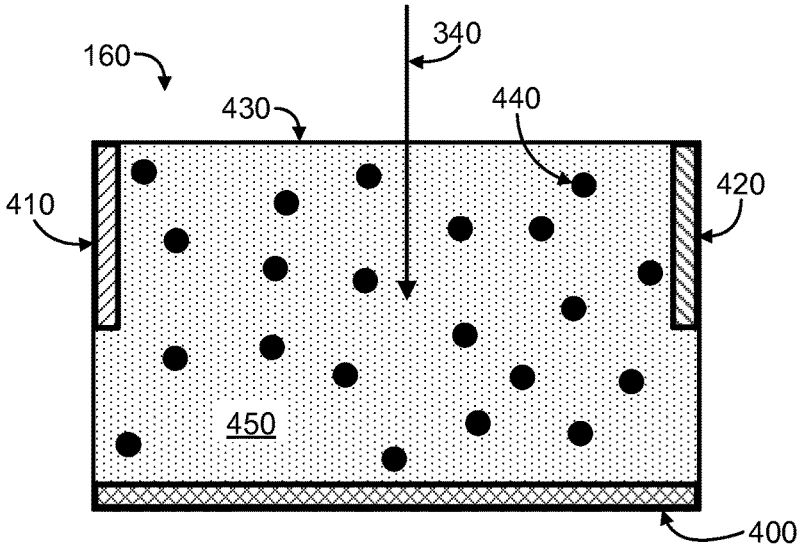
FIG. 27 illustrates a top view of the example electro-dispersive pixel of FIG. 26.

FIG. 27 illustrates a top view of example electro-dispersive pixel 160 of FIG. 26. In particular embodiments, enclosure 430 may contain an electrically controllable material that is moveable within a volume of the enclosure, and the electrically controllable material may be at least partially opaque to visible light. As an example and not by way of limitation, the electrically controllable material may be reflective or may be white, black, gray, blue, or any other suitable color. In particular embodiments, pixels 160 of a display may be configured to receive a voltage applied between front electrode 400 and attractor electrode 410 and produce an electric field based on the applied voltage, where the electric field extends, at least in part, through the volume of pixel enclosure 430. In particular embodiments, the electrically controllable material may be configured to move toward front electrode 400 or attractor electrode 410 in response to an applied electric field. In particular embodiments, the electrically controllable material may include opaque particles 440 that are white, black, or reflective, and the particles may be suspended in a transparent fluid 450 contained within the pixel volume. As an example and not by way of limitation, electro-dispersive particles 440 may be made of titanium dioxide (which may appear white) and may have a diameter of approximately 1 μm. As another example and not by way of limitation, electro-dispersive particles 440 may be made of any suitable material and may be coated with a colored or reflective coating. Particles 440 may have any suitable size, such as for example, a diameter of 0.1 μm, 1 μm, or 10 μm. Particles 440 may have any suitable range of diameters (such as for example diameters ranging from 1 μm to 2 μm). Although this disclosure describes and illustrates particular electro-dispersive particles having particular compositions and particular sizes, this disclosure contemplates any suitable electro-dispersive particles having any suitable compositions and any suitable sizes. In particular embodiments, the operation of electro-dispersive pixel 160 may involve electrophoresis, where particles 440 have an electrical charge or an electrical dipole, and the particles may be moved using an applied electric field. As an example and not by way of limitation, particles 440 may have a positive charge and may be attracted to a negative charge or the negative side of an electric field. Alternately, particles 440 may have a negative charge and may be attracted to a positive charge or the positive side of an electric field. When electro-dispersive pixel 160 is configured to be transparent, particles 440 may be moved to attractor electrode 410, allowing incident light (e.g., light ray 340) to pass through pixel 160. When pixel 160 is configured to be opaque, particles 440 may be moved to front electrode 400, scattering or absorbing incident light.

Figure 28A:
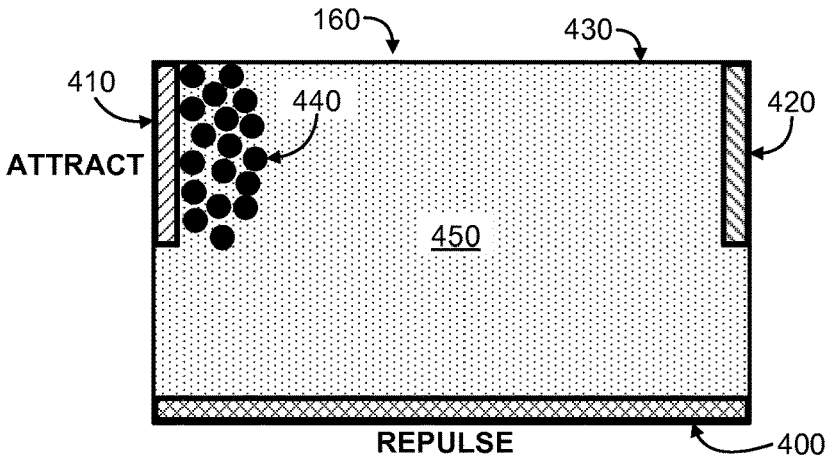
FIGS. 28A-28C each illustrate a top view of an example electro-dispersive pixel.
Figure 28B:
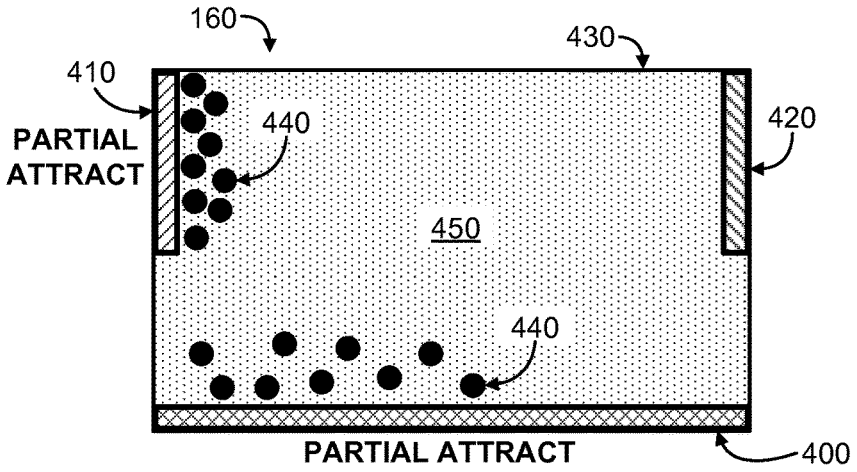
Figure 28C:
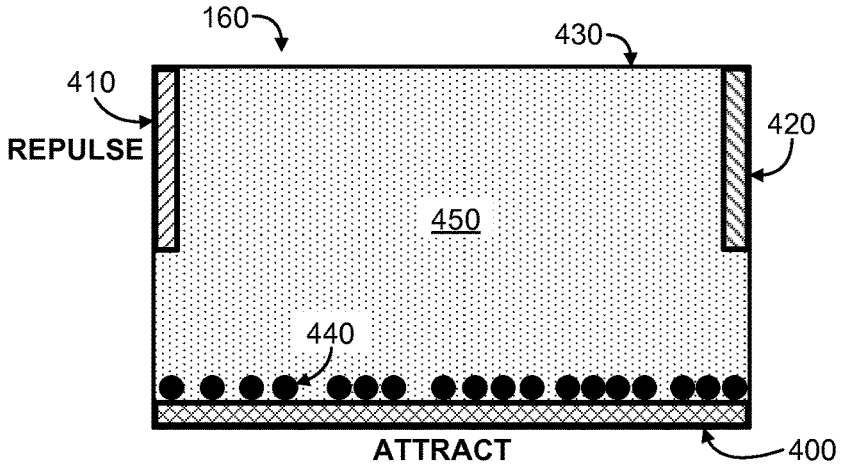

FIGS. 28A-28C each illustrate a top view of example electro-dispersive pixel 160. In particular embodiments, pixel 160 may be configured to operate in multiple modes, including a transparent mode (as illustrated in FIG. 28A), a partially transparent mode (as illustrated in FIG. 28B), and an opaque mode (as illustrated in FIG. 28C). In the examples of FIGS. 28A-28C, the electrodes are labeled "ATTRACT," "REPULSE," and "PARTIAL ATTRACT," depending on the mode of operation. In particular embodiments, "ATTRACT" refers to an electrode configured to attract particles 440, while "REPULSE" refers to an electrode configured to repulse particles 440, and vice versa. The relative voltages applied to the electrodes depends on whether particles 440 have positive or negative charges. As an example and not by way of limitation, if particles 440 have a positive charge, then an "ATTRACT" electrode may be coupled to ground, while a "REPULSE" electrode may have a positive voltage (e.g., +5 V) applied to it. In this case, positively charged particles 440 would be attracted to the ground electrode and repulsed by the positive electrode.

In a transparent mode of operation, a substantial portion (e.g., greater than 80%, 90%, 95%, or any suitable percentage) of electrically controllable material 440 may be attracted to and located near attractor electrode 410, resulting in pixel 160 being substantially transparent to incident visible light. As an example and not by way of limitation, if particles 440 have a negative charge, then attractor electrode 410 may have an applied positive voltage (e.g., +5 V), while front electrode 400 is coupled to a ground potential (e.g., 0 V). As illustrated in FIG. 28A, particles 440 are clumped about attractor electrode 410 and may prevent only a small fraction of incident light from propagating through pixel 160. In a transparent mode, little or none of electrically controllable material 440 (e.g., less than 20%, 10%, 5%, or any suitable percentage) may be located near front electrode 400, and pixel 160 may transmit greater than 70%, 80%, 90%, 95%, or any suitable percentage of visible light incident on a front or back surface of pixel 160.

In a partially transparent mode of operation, a first portion of electrically controllable material 440 may be located near front electrode 400, and a second portion of electrically controllable material 440 may be located near attractor electrode 410. In particular embodiments, the first and second portions of electrically controllable material 440 may each include between 10% and 90% of the electrically controllable material. In the partially transparent mode illustrated in FIG. 28B, front electrode 400 and attractor electrode 410 may each be configured to be partially attractive to particles 440. In FIG. 28B, approximately 50% of particles 440 are located near attractor electrode 410, and approximately 50% of particles 440 are located near front electrode 400. In particular embodiments, when operating in a partially transparent mode, an amount of the first or second portions may be approximately proportional to a voltage applied between front electrode 400 and attractor electrode 410. As an example and not by way of limitation, if particles 440 have a negative charge and front electrode 400 is coupled to ground, then an amount of particles 440 located near attractor electrode 410 may be approximately proportional to a voltage applied to attractor electrode 410. Additionally, an amount of particles 440 located near front electrode 400 may be inversely proportional to the voltage applied to attractor electrode 410. In particular embodiments, when operating in a partially transparent mode, electro-dispersive pixel 160 may be partially opaque, where electro-dispersive pixel 160 is partially transparent to visible light and partially reflects, scatters, or absorbs visible light. In a partially transparent mode, pixel 160 is partially transparent to incident visible light, where an amount of transparency may be approximately proportional to the portion of electrically controllable material 440 located near attractor electrode 410.

In an opaque mode of operation, a substantial portion (e.g., greater than 80%, 90%, 95%, or any suitable percentage) of electrically controllable material 440 may be located near front electrode 400. As an example and not by way of limitation, if particles 440 have a negative charge, then attractor electrode 410 may be coupled to a ground potential, while front electrode 400 has an applied positive voltage (e.g., +5 V). In particular embodiments, when operating in an opaque mode, pixel 160 may be substantially opaque, where pixel 160 reflects, scatters, or absorbs substantially all incident visible light. As illustrated in FIG. 28C, particles 440 may be attracted to front electrode 400, forming an opaque layer on the electrode and preventing light from passing through pixel 160. In particular embodiments, particles 440 may be white or reflecting, and in an opaque mode, pixel 160 may appear white. In other particular embodiments, particles 440 may be black or absorbing, and in an opaque mode, pixel may appear black.

In particular embodiments, electrically controllable material 440 may be configured to absorb one or more spectral components of light and transmit one or more other spectral components of light. As an example and not by way of limitation, electrically controllable material 440 may be configured to absorb red light and transmit green and blue light. Three or more pixels may be combined together to form a color pixel that may be configured to display color, and multiple color pixels may be combined to form a color display. In particular embodiments, a color electro-dispersive display may be made by using particles 440 with different colors. As an example and not by way of limitation, particles 440 may be selectively transparent or reflective to specific colors (e.g., red, green, or blue), and a combination of three or more colored electro-dispersive pixels 160 may be used to form a color pixel.

In particular embodiments, when moving particles 440 from attractor electrode 410 to front electrode 400, disperser electrode 420, located opposite attractor electrode 410, may be used to disperse particles 440 away from attractor electrode 410 before an attractive voltage is applied to front electrode 400. As an example and not by way of limitation, before applying a voltage to front electrode 400 to attract particles 440, a voltage may first be applied to disperser electrode 420 to draw particles 440 away from attractor electrode 410 and into the pixel volume. This action may result in particles 440 being distributed substantially uniformly across front electrode 440 when front electrode 440 is configured to attract particles 440. In particular embodiments, electro-dispersive pixels 160 may preserve their state when power is removed, and an electro-dispersive pixel 160 may only require power when changing its state (e.g., from transparent to opaque). In particular embodiments, an electro-dispersive display may continue to display information after power is removed. An electro-dispersive display may only consume power when updating displayed information, and an electro-dispersive display may consume very low or no power when updates to the displayed information are not being executed.

Figure 29:
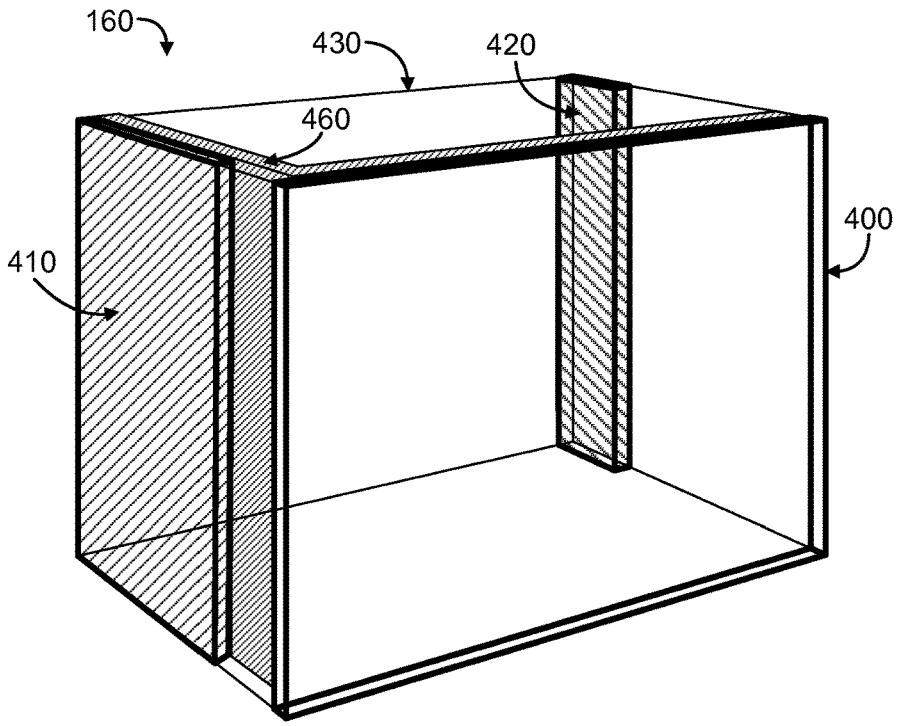
FIG. 29 illustrates a perspective view of an example electrowetting pixel.

FIG. 29 illustrates a perspective view of example electrowetting pixel 160. In particular embodiments, an electrowetting display may include multiple electrowetting pixels 160 arranged to form a display screen, where each electrowetting pixel 160 may be individually addressable (e.g., using an active-matrix or a passive-matrix scheme). In particular embodiments, electrowetting pixel may include front electrode 400, attractor electrode 410, liquid electrode 420, pixel enclosure 430, or hydrophobic coating 460. Front electrode 400 may be oriented substantially parallel to a viewing surface of the display screen, and front electrode 400 may be substantially transparent to visible light. Front electrode 400 may be an ITO electrode deposited on an interior or exterior surface of a front or back wall of enclosure 430. Attractor electrode 410 and liquid electrode 420 (located opposite attractor electrode 410) may each be oriented at an angle with respect to front electrode 400. As an example and not by way of limitation, attractor electrode 410 and liquid electrode 420 may each be substantially orthogonal to front electrode 400. Attractor electrode 410 or liquid electrode 420 may each be attached to or deposited on an interior or exterior surface of a side wall of enclosure 430. Attractor electrode 410 and liquid electrode 420 may each be made of a thin film of ITO or a thin film of other conductive material (e.g., gold, silver, copper, chrome, or a conductive form of carbon).

Figure 30:
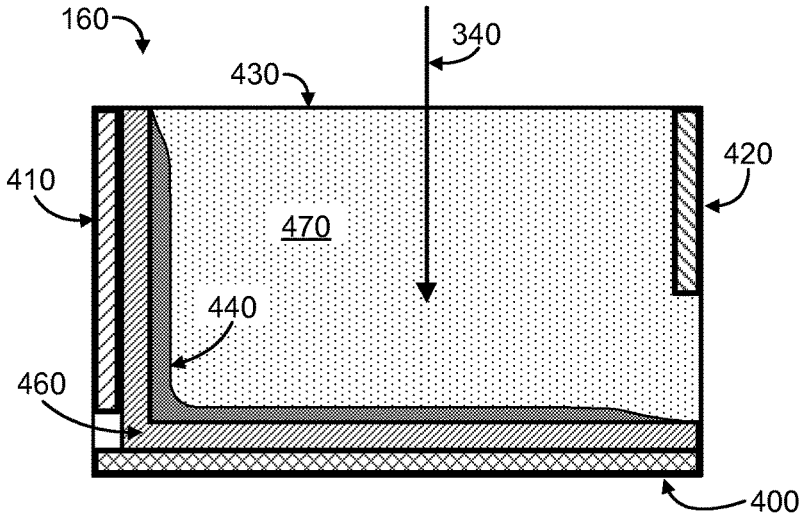
FIG. 30 illustrates a top view of the example electrowetting pixel of FIG. 29.

FIG. 30 illustrates a top view of example electrowetting pixel 160 of FIG. 29. In particular embodiments, electrically controllable material 440 may include an electrowetting fluid 440 that may be colored or opaque. As an example and not by way of limitation, electrowetting fluid 440 may appear black (e.g., may substantially absorb light) or may absorb or transmit some color components (e.g., may absorb red light and transmit blue and green light). Electrowetting fluid 440 may be contained within the pixel volume along with transparent fluid 470, and electrowetting fluid 440 and transparent fluid 470 may be immiscible. In particular embodiments, electrowetting fluid 440 may include an oil, and transparent fluid 470 may include water. In particular embodiments, electrowetting may refer to a modification of the wetting properties of a surface by an applied electric field, and an electrowetting fluid 440 may refer to a fluid that moves or is attracted to a surface in response to an applied electric field. As an example and not by way of limitation, electrowetting fluid 440 may move toward an electrode having a positive applied voltage. When electrowetting pixel 160 is configured to be transparent, electrowetting fluid 440 may be moved adjacent to attractor electrode 410, allowing incident light (e.g., light ray 340) to pass through pixel 160. When pixel 160 is configured to be opaque, electrowetting fluid 440 may be moved adjacent to front electrode 400, causing incident light to be scattered or absorbed by electrowetting fluid 440.

In particular embodiments, electrowetting pixel 160 may include hydrophobic coating 460 disposed on one or more surfaces of pixel enclosure 430. Hydrophobic coating 460 may be located between electrowetting fluid 440 and the front and attractor electrodes. As an example and not by way of limitation, hydrophobic coating 460 may be affixed to or deposited on interior surfaces of one or more walls of pixel enclosure 430 that are adjacent to front electrode 400 and attractor electrode 410. In particular embodiments, hydrophobic coating 460 may include a material that electrowetting fluid 440 can wet easily, which may result in electrowetting fluid forming a substantially uniform layer (rather than beads) on a surface adjacent to the electrodes.

Figure 31A:
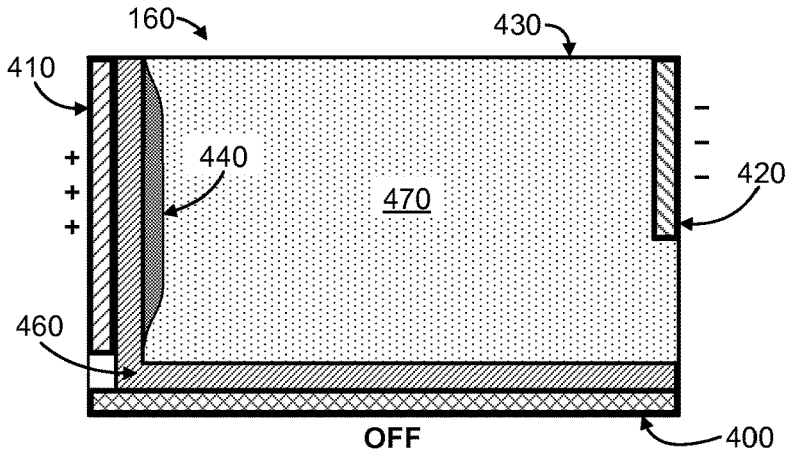
FIGS. 31A-31C each illustrate a top view of an example electrowetting pixel.
Figure 31B:
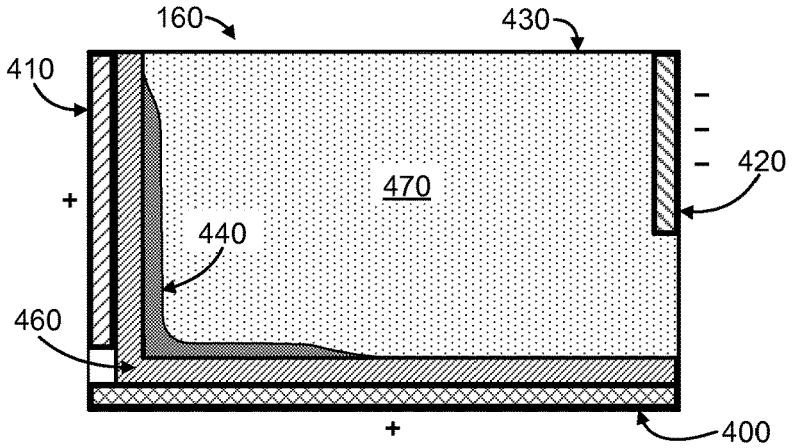
Figure 31C:
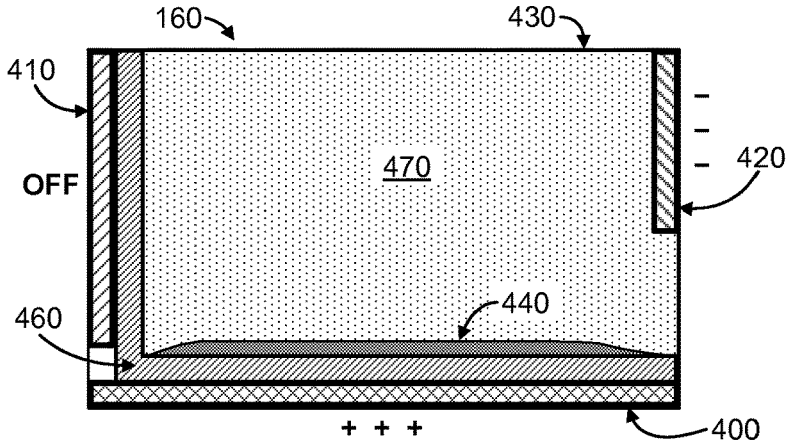

FIGS. 31A-31C each illustrate a top view of example electrowetting pixel 160. In particular embodiments, electrowetting pixel 160 may be configured to operate in multiple modes, including a transparent mode (as illustrated in FIG. 31A), a partially transparent mode (as illustrated in FIG. 31B), and an opaque mode (as illustrated in FIG. 31C). Electrodes in FIGS. 31A-31C are labeled with positive and negative charge symbols indicating the relative charge and polarity of the electrodes. In the transparent mode of operation illustrated in FIG. 31A, front electrode 400 is off (e.g., no charge or applied voltage), attractor electrode 410 has a positive charge or voltage, and, relative to attractor electrode 410, liquid electrode 420 has a negative charge or voltage. As an example and not by way of limitation, a +5 V voltage may be applied to attractor electrode 410, and liquid electrode 420 may be coupled to ground. In a transparent mode of operation, a substantial portion (e.g., greater than 80%, 90%, 95%, or any suitable percentage) of electrowetting fluid 440 may be attracted to and located near attractor electrode 410, resulting in pixel 160 being substantially transparent to incident visible light. In the partially transparent mode of operation illustrated in FIG. 31B, a first portion of electrowetting fluid 440 is located near front electrode 400, and a second portion of electrowetting fluid 440 is located near attractor electrode 410. Front electrode 400 and attractor electrode 410 are each be configured to attract electrowetting fluid 440, and the amount of electrowetting fluid 440 on each electrode depends on the relative charge or voltage applied to the electrodes. When operating in a partially transparent mode, electrowetting pixel 160 may be partially opaque and partially transparent. In the opaque mode of operation illustrated in FIG. 31C, a substantial portion (e.g., greater than 80%, 90%, 95%, or any suitable percentage) of electrowetting fluid 440 is located near front electrode 400. Front electrode 400 has a positive charge, and attractor electrode 410 is off, resulting in the movement of electrowetting fluid to a surface of pixel enclosure 430 adjacent to front electrode 400. In particular embodiments, in opaque mode, electrowetting pixel 160 may be substantially opaque, reflecting, scattering, or absorbing substantially all incident visible light. As an example and not by way of limitation, electrowetting fluid 440 may be black or absorbing, and pixel 160 may appear black.

In particular embodiments, a PDLC display or an electrochromic display may be fabricated using one or more glass substrates or plastic substrates. As an example and not by way of limitation, a PDLC or electrochromic display may be fabricated with two glass or plastic sheets with the PDLC or electrochromic material, respectively, sandwiched between the two sheets. In particular embodiments, a PDLC or electrochromic display may be fabricated on a plastic substrate using a roll-to-roll processing technique. In particular embodiments, a display fabrication process may include patterning a substrate to include a passive or active matrix. As an example and not by way of limitation, a substrate may be patterned with a passive matrix that includes conductive areas or lines that extend from one edge of a display to another edge. As another example and not by way of limitation, a substrate may be patterned and coated to produce a set of transistors for an active matrix. A first substrate may include the set of transistors which may be configured to couple two traces together (e.g., a hold trace and a scan trace), and a second substrate located on an opposite side of the display from the first substrate may include a set of conductive lines. In particular embodiments, conductive lines or traces may extend to an end of a substrate and may be coupled (e.g., via pressure-fit or zebra-stripe connector pads) to one or more control boards. In particular embodiments, an electro-dispersive display or an electrowetting display may be fabricated by patterning a bottom substrate with conductive lines that form connections for pixel electrodes. In particular embodiments, a plastic grid may be attached to the bottom substrate using ultrasonic, chemical, or thermal attachment techniques (e.g., ultrasonic, chemical, thermal, or spot welding). In particular embodiments, the plastic grid or bottom substrate may be patterned with conductive materials (e.g., metal or ITO) to form electrodes. In particular embodiments, the cells may be filled with a working fluid (e.g., the cells may be filled using immersion, inkjet deposition, or screen or rotogravure transfer). As an example and not by way of limitation, for an electro-dispersive display, the working fluid may include opaque charged particles suspended in a transparent liquid (e.g., water). As another example and not by way of limitation, for an electrowetting display, the working fluid may include a combination of an oil and water. In particular embodiments, a top substrate may be attached to the plastic grid, and the top substrate may seal the cells. In particular embodiments, the top substrate may include transparent electrodes. Although this disclosure describes particular techniques for fabricating particular displays, this disclosure contemplates any suitable techniques for fabricating any suitable displays.

Figure 32:
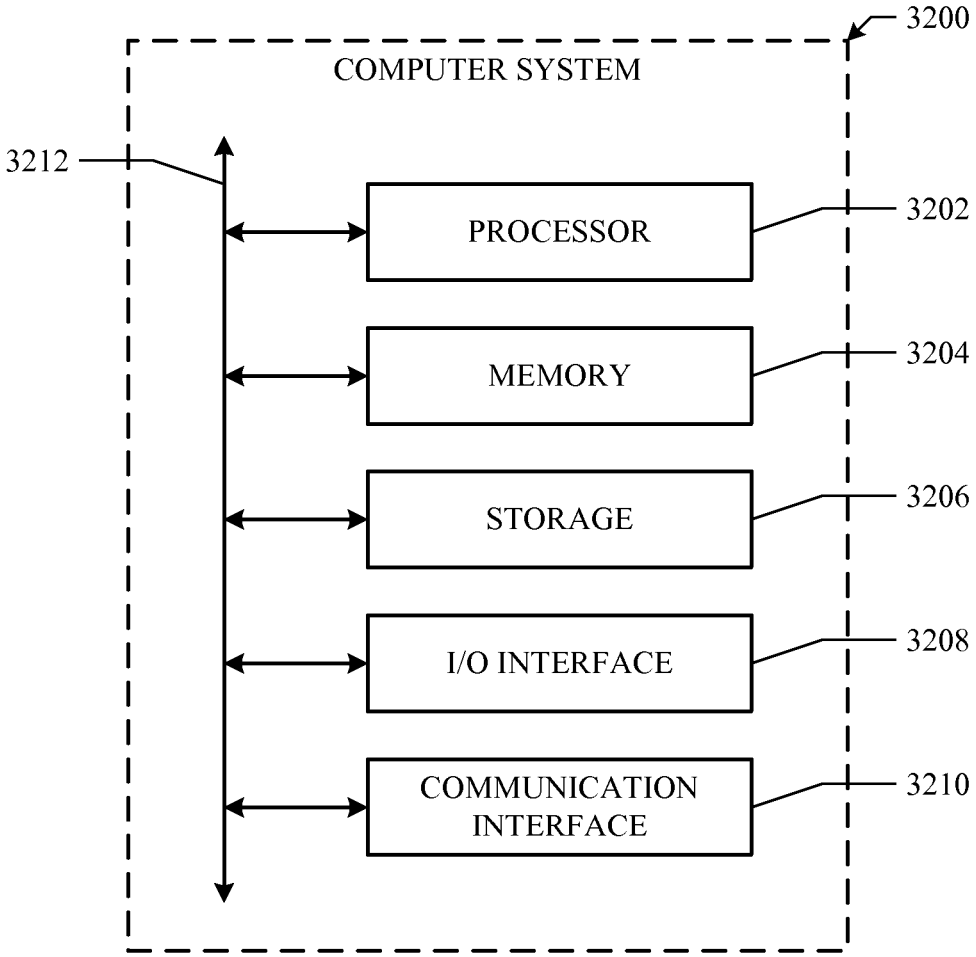
FIG. 32 illustrates an example computer system.

FIG. 32 illustrates an example computer system 3200. In particular embodiments, one or more computer systems 3200 perform one or more steps of one or more methods described or illustrated herein. In particular embodiments, one or more computer systems 3200 provide functionality described or illustrated herein. In particular embodiments, software running on one or more computer systems 3200 performs one or more steps of one or more methods described or illustrated herein or provides functionality described or illustrated herein. Particular embodiments include one or more portions of one or more computer systems 3200. Herein, reference to a computer system may encompass a computing device, and vice versa, where appropriate. Moreover, reference to a computer system may encompass one or more computer systems, where appropriate.

This disclosure contemplates any suitable number of computer systems 3200. This disclosure contemplates computer system 3200 taking any suitable physical form. As example and not by way of limitation, computer system 3200 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, or a combination of two or more of these. Where appropriate, computer system 3200 may include one or more computer systems 3200; be unitary or distributed; span multiple locations; span multiple machines; span multiple data centers; or reside in a cloud, which may include one or more cloud components in one or more networks. Where appropriate, one or more computer systems 3200 may perform without substantial spatial or temporal limitation one or more steps of one or more methods described or illustrated herein. As an example and not by way of limitation, one or more computer systems 3200 may perform in real time or in batch mode one or more steps of one or more methods described or illustrated herein. One or more computer systems 3200 may perform at different times or at different locations one or more steps of one or more methods described or illustrated herein, where appropriate.

In particular embodiments, computer system 3200 includes a processor 3202, memory 3204, storage 3206, an input/output (I/O) interface 3208, a communication interface 3210, and a bus 3212. Although this disclosure describes and illustrates a particular computer system having a particular number of particular components in a particular arrangement, this disclosure contemplates any suitable computer system having any suitable number of any suitable components in any suitable arrangement.

In particular embodiments, processor 3202 includes hardware for executing instructions, such as those making up a computer program. As an example and not by way of limitation, to execute instructions, processor 3202 may retrieve (or fetch) the instructions from an internal register, an internal cache, memory 3204, or storage 3206; decode and execute them; and then write one or more results to an internal register, an internal cache, memory 3204, or storage 3206. In particular embodiments, processor 3202 may include one or more internal caches for data, instructions, or addresses. This disclosure contemplates processor 3202 including any suitable number of any suitable internal caches, where appropriate. As an example and not by way of limitation, processor 3202 may include one or more instruction caches, one or more data caches, and one or more translation lookaside buffers (TLBs). Instructions in the instruction caches may be copies of instructions in memory 3204 or storage 3206, and the instruction caches may speed up retrieval of those instructions by processor 3202. Data in the data caches may be copies of data in memory 3204 or storage 3206 for instructions executing at processor 3202 to operate on; the results of previous instructions executed at processor 3202 for access by subsequent instructions executing at processor 3202 or for writing to memory 3204 or storage 3206; or other suitable data. The data caches may speed up read or write operations by processor 3202. The TLBs may speed up virtual-address translation for processor 3202. In particular embodiments, processor 3202 may include one or more internal registers for data, instructions, or addresses. This disclosure contemplates processor 3202 including any suitable number of any suitable internal registers, where appropriate. Where appropriate, processor 3202 may include one or more arithmetic logic units (ALUs); be a multi-core processor; or include one or more processors 3202. Although this disclosure describes and illustrates a particular processor, this disclosure contemplates any suitable processor.

In particular embodiments, memory 3204 includes main memory for storing instructions for processor 3202 to execute or data for processor 3202 to operate on. As an example and not by way of limitation, computer system 3200 may load instructions from storage 3206 or another source (such as, for example, another computer system 3200) to memory 3204. Processor 3202 may then load the instructions from memory 3204 to an internal register or internal cache. To execute the instructions, processor 3202 may retrieve the instructions from the internal register or internal cache and decode them. During or after execution of the instructions, processor 3202 may write one or more results (which may be intermediate or final results) to the internal register or internal cache. Processor 3202 may then write one or more of those results to memory 3204. In particular embodiments, processor 3202 executes only instructions in one or more internal registers or internal caches or in memory 3204 (as opposed to storage 3206 or elsewhere) and operates only on data in one or more internal registers or internal caches or in memory 3204 (as opposed to storage 3206 or elsewhere). One or more memory buses (which may each include an address bus and a data bus) may couple processor 3202 to memory 3204. Bus 3212 may include one or more memory buses, as described below. In particular embodiments, one or more memory management units (MMUs) reside between processor 3202 and memory 3204 and facilitate accesses to memory 3204 requested by processor 3202. In particular embodiments, memory 3204 includes random access memory (RAM). This RAM may be volatile memory, where appropriate, and this RAM may be dynamic RAM (DRAM) or static RAM (SRAM), where appropriate. Moreover, where appropriate, this RAM may be single-ported or multi-ported RAM. This disclosure contemplates any suitable RAM. Memory 3204 may include one or more memories 3204, where appropriate. Although this disclosure describes and illustrates particular memory, this disclosure contemplates any suitable memory.

In particular embodiments, storage 3206 includes mass storage for data or instructions. As an example and not by way of limitation, storage 3206 may include a hard disk drive (HDD), a floppy disk drive, flash memory, an optical disc, a magneto-optical disc, magnetic tape, or a Universal Serial Bus (USB) drive or a combination of two or more of these. Storage 3206 may include removable or non-removable (or fixed) media, where appropriate. Storage 3206 may be internal or external to computer system 3200, where appropriate. In particular embodiments, storage 3206 is non-volatile, solid-state memory. In particular embodiments, storage 3206 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 3206 taking any suitable physical form. Storage 3206 may include one or more storage control units facilitating communication between processor 3202 and storage 3206, where appropriate. Where appropriate, storage 3206 may include one or more storages 3206. Although this disclosure describes and illustrates particular storage, this disclosure contemplates any suitable storage.

In particular embodiments, I/O interface 3208 includes hardware, software, or both, providing one or more interfaces for communication between computer system 3200 and one or more I/O devices. Computer system 3200 may include one or more of these I/O devices, where appropriate. One or more of these I/O devices may enable communication between a person and computer system 3200. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 3208 for them. Where appropriate, I/O interface 3208 may include one or more device or software drivers enabling processor

3202 to drive one or more of these I/O devices. I/O interface 3208 may include one or more I/O interfaces 3208, where appropriate. Although this disclosure describes and illustrates a particular I/O interface, this disclosure contemplates any suitable I/O interface.

In particular embodiments, communication interface 3210 includes hardware, software, or both providing one or more interfaces for communication (such as, for example, packet-based communication) between computer system 3200 and one or more other computer systems 3200 or one or more networks. As an example and not by way of limitation, communication interface 3210 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 3210 for it. As an example and not by way of limitation, computer system 3200 may communicate with an ad hoc network, a personal area network (PAN), a local area network (LAN), a wide area network (WAN), a metropolitan area network (MAN), body area network (BAN), or one or more portions of the Internet or a combination of two or more of these. One or more portions of one or more of these networks may be wired or wireless. As an example, computer system 3200 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 3200 may include any suitable communication interface 3210 for any of these networks, where appropriate. Communication interface 3210 may include one or more communication interfaces 3210, where appropriate. Although this disclosure describes and illustrates a particular communication interface, this disclosure contemplates any suitable communication interface.

In particular embodiments, bus 3212 includes hardware, software, or both coupling components of computer system 3200 to each other. As an example and not by way of limitation, bus 3212 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 3212 may include one or more buses 3212, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This scope of this disclosure encompasses all changes, substitutions, variations, alterations, and modifications to the example embodiments herein that a person having ordinary skill in the art would comprehend. The scope of this disclosure is not limited to the example embodiments described or illustrated herein. Moreover, although this disclosure describes or illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A device comprising a plurality of display screens comprising:

a first display screen comprising a first viewing surface, the first display screen comprising a plurality of first display pixels;

a second display screen comprising a second viewing surface in front of the first display screen and parallel to the first viewing surface, the second display screen comprising a plurality of second display pixels, each of the plurality of second display pixels comprising:

an enclosure containing electrically controllable material that is moveable within a volume of the enclosure, the electrically controllable material being at least partially opaque to visible light;

wherein:

located above each first display pixel of the first display screen are at least two of the plurality of second display pixels;

each second display pixel overlays only one first display pixel in a direction perpendicular to the first and second viewing surfaces; and each of the plurality of second display pixels is configured to operate in a plurality of modes comprising:

a first mode in which the second display pixel modulates, absorbs, or reflects visible light;

a second mode in which the second display pixel is substantially transparent to visible light; and a third mode in which the second display pixel is partially transparent to visible light.

2. The device of claim 1, wherein in the second mode the second display pixel does not emit visible light.

3. The device of claim 1, wherein in the second mode the second display pixel does not modulate an amount of a color of visible light.

4. The device of claim 1, wherein the second display pixels further comprise:

a first electrode oriented substantially parallel to the second viewing surface, the first electrode being substantially transparent to visible light; and a second electrode oriented at a first angle with respect to the second viewing surface.

5. The device of claim 4, wherein each of the first and second electrodes comprises an electrically conductive material disposed on a respective first and second surface of the enclosure.

6. The device of claim 5, wherein the first electrode comprises a thin film of indium tin oxide deposited on the first surface of the enclosure.

7. The device of claim 4, wherein:

each of the second display pixels is configured to receive a voltage applied between the first and second electrodes and produce an electric field based on the applied voltage, the electric field extending, at least in part, through the volume of the enclosure; and the electrically controllable material is configured to move toward the first or second electrode in response to the electric field.

8. The device of claim 4, wherein:

the electrically controllable material comprises an electrowetting fluid; and the electrowetting fluid is contained within the volume along with a transparent fluid with which the electrowetting fluid is immiscible.

9. The device of claim 8, wherein:

the electrowetting fluid comprises an oil;

the transparent fluid comprises water; and each of the second display pixels further comprise a hydrophobic coating disposed on one or more surfaces of the enclosure adjacent to the first and second electrodes, the hydrophobic coating located between the electrowetting fluid and the first and second electrodes.

10. The device of claim 4, wherein:

in the first mode a substantial portion of the electrically controllable material is located near the first electrode; and in the second mode the substantial portion of the electrically controllable material is located near the second electrode.

11. The device of claim 4, wherein:

in the first mode a substantial portion of the electrically controllable material is located near the first electrode;

in the second mode the substantial portion of the electrically controllable material is located near the second electrode;

in the third mode a first portion of the electrically controllable material is located near the first electrode and a second portion of the electrically controllable material is located near the second electrode;

the substantial portion of the electrically controllable material comprises greater than 90% of the electrically controllable material; and the first and second portions of the electrically controllable material each comprises between 10% and 90% of the electrically controllable material.

12. The device of claim 4, wherein each of the plurality of second display pixels further comprises a third electrode oriented at a second angle with respect to the first electrode, the third electrode disposed on a surface of the enclosure opposite the second electrode.

13. The device of claim 12, wherein during a transition from the first mode to the second or third mode, a voltage of the third electrode is configured to have a polarity opposite the polarity of the voltage of the first electrode and the voltage of the second electrode.

14. The device of claim 4, further comprising:

one or more non-transitory computer-readable storage media embodying instructions that are executable by one or more processors coupled to the storage media; and the one or more processors coupled to the storage media, the one or more processors operable to execute the instructions to control a voltage difference between the first electrode and the second electrode of at least a first one of the plurality of second display pixels to transition that pixel between the first and second mode.

15. The device of claim 1, wherein:

the electrically controllable material comprises electrically charged particles that are white, black, or reflective; and the particles are suspended in a transparent fluid contained within the volume.

16. The device of claim 1, wherein:

the electrically controllable material is at least partially opaque to visible light;

in the third mode the second display pixel is partially opaque, wherein the second display pixel is partially transparent to visible light and partially absorbs or reflects visible light; and in the first mode the second display pixel is substantially opaque, wherein the second display pixel absorbs or reflects substantially all incident visible light.

17. The device of claim 1, wherein, in the second mode, the second display pixel transmits greater than 90% of visible light incident on a front or back surface of the pixel.

18. The device of claim 1, wherein:

the electrically controllable material is configured to absorb red light and transmit green and blue light;

in the first mode the second display pixel transmits green and blue light and absorbs substantially all incident red light; and in the third mode the second display pixel transmits green and blue light and partially absorbs red light.

19. A method comprising:

fabricating a device comprising a plurality of display screens, the display screens comprising:

a first display screen comprising a first viewing surface, the first display screen comprising a plurality of first display pixels;

a second display screen comprising a second viewing surface in front of the first display screen and parallel to the first viewing surface, the second display screen comprising a plurality of second display pixels, each of the plurality of second display pixels comprising:

an enclosure containing electrically controllable material that is moveable within a volume of the enclosure, the electrically controllable material being at least partially opaque to visible light;

wherein:

located above each first display pixel of the first display screen are at least two of the plurality of second display pixels;

each second display pixel overlays only one first display pixel in a direction perpendicular to the first and second viewing surfaces; and each of the plurality of second display pixels is configured to operate in a plurality of modes comprising:

a first mode in which the second display pixel modulates, absorbs, or reflects visible light;

a second mode in which the second display pixel is substantially transparent to visible light; and a third mode in which the second display pixel is partially transparent to visible light.

20. The method of claim 19, wherein at least one of the plurality of display screens comprises a PDLC display or an electrochromic display, and fabricating the device comprising the plurality of display screens comprises fabricating, using one or more glass or plastic substrates, the PDLC display or the electrochromic display.

21. The method of claim 20, wherein the one or more substrates comprise one or more plastic substrates; and fabricating the device comprising the plurality of display screens comprises fabricating at least one of the display screens using a roll-to-roll processing technique.

22. The method of claim 19, wherein fabricating the device comprising the plurality of display screens comprises patterning a passive or active matrix on a substrate.

23. The method of claim 19, wherein at least one of the display screens comprises an electro-dispersive display screen or an electrowetting display screen; and fabricating the device comprising the plurality of display screens comprises patterning a substrate with conductive lines that form connections between one or more electrodes of at least one of the plurality of second display pixels.

24. The method of claim 23, wherein the substrate comprises a bottom layer for one or more cells, each cell forming part of at least one second display pixel, the method further comprising:

filling the cells with a working fluid.

25. The method of claim 24, wherein:

at least one of the display screens comprises an electro-dispersive display; and the working fluid comprises one or more opaque, charged particles suspended in a transparent liquid.

26. The method of claim 24, wherein:

at least one of the display screens comprises an electrowetting display; and the working fluid comprises a mixture of oil and water.

27. The method of claim 24, further comprising sealing the one or more cells by covering the cells with a top layer.

* * * * *